US006585345B2

(12) United States Patent
Kosugi

(10) Patent No.: US 6,585,345 B2
(45) Date of Patent: Jul. 1, 2003

(54) PRINTING APPARATUS AND INK CARTRIDGE THEREFOR

(75) Inventor: Yasuhiko Kosugi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/002,164

(22) Filed: Dec. 5, 2001

(65) Prior Publication Data

US 2002/0080205 A1 Jun. 27, 2002

(30) Foreign Application Priority Data

| | | |
|---|---|---|
| Dec. 5, 2000 | (JP) | 2000-369904 |
| Dec. 5, 2000 | (JP) | 2000-369905 |
| Nov. 30, 2001 | (JP) | 2001-367075 |

(51) Int. Cl.[7] ..... B41J 29/393; B41J 29/38; B41J 2/165

(52) U.S. Cl. ..... 347/19; 347/14; 347/23

(58) Field of Search ..... 347/19, 12, 23, 347/14, 10, 11, 85, 86, 87, 34, 35, 36, 7, 6, 20

(56) References Cited

U.S. PATENT DOCUMENTS

| | | | | |
|---|---|---|---|---|
| 4,872,027 A | * | 10/1989 | Buskirk et al. | 347/19 |
| 5,049,898 A | | 9/1991 | Arthur et al. | |
| 5,365,312 A | | 11/1994 | Hillmann et al. | 355/206 |
| 5,610,635 A | | 3/1997 | Murray et al. | 347/7 |

FOREIGN PATENT DOCUMENTS

| | | |
|---|---|---|
| EP | 0 589 581 A2 | 3/1994 |
| EP | 0 783 968 A2 | 7/1997 |
| JP | 2933347 | 5/1999 |
| WO | WO 98/52762 A2 | 11/1998 |

OTHER PUBLICATIONS

Japanese Patent Abstract No. JP 2000–255080A, Publication Date Sep. 19, 2000.
Japanese Patent Abstrat 02–279344.

* cited by examiner

*Primary Examiner*—Lamson Nguyen
*Assistant Examiner*—Charles W. Stewart, Jr.
(74) *Attorney, Agent, or Firm*—Sughrue Mion, PLLC

(57) ABSTRACT

A printing apparatus which may effectively manage information related to each ink cartridge and an ink cartridge therefor are provided. A printing apparatus having a cartridge mounting portion on which a plurality of ink cartridges are detachably mountable, each ink cartridge having an element which may be written with information, an accumulating means for accumulating a discharge amount of ink discharged for every ink cartridge mounted on the cartridge mounting portion, and a writing member for writing information into the element, in which the writing member writes information into an element in the ink cartridge selected according to an accumulated result of the accumulating means, out of the plurality of ink cartridges mounted on the cartridge mounting portion.

31 Claims, 13 Drawing Sheets

MOVEMENT OF CARRIAGE WHEN READING ID INFORMATION

| | START | BEFORE 1ST FLUSHING | AFTER 1ST FLUSHING | BEFORE 2ND FLUSHING | AFTER 2ND FLUSHING |
|---|---|---|---|---|---|
| BLACK (31) | 0 | 54 | 54 | 112 (58) | 0 |
| CYAN (32) | 0 | 81 | 0 | 78 (78) | 78 |
| MAGENTA (33) | 0 | 32 | 32 | 59 (27) | 59 |
| YELLOW (34) | 0 | 13 | 13 | 41 (28) | 41 |

FIG. 9

| | THRE SHOLD | START | 1ST TIME THRESHOLD IS REACHED | AFTER 1ST WRITING | 2ND TIME THRESHOLD IS REACHED | AFTER 2ND WRITING |
|---|---|---|---|---|---|---|
| BLACK (31) | 70 | 0 | 70 | 0 | 56 (56) | 56 |
| CYAN (32) | 50 | 0 | 38 | 38 | 50 (12) | 0 |
| MAGENTA (33) | 50 | 0 | 21 | 21 | 44 (23) | 44 |
| YELLOW (34) | 50 | 0 | 15 | 15 | 28 (13) | 28 |

FIG. 10

PRINTING APPARATUS AND INK CARTRIDGE THEREFOR

BACKGROUND OF THE INVENTION

The present application claims priority upon Japanese Patent Application Nos. 2000-369904 and 2000-369905 filed on Dec. 5, 2000 respectively, and Japanese Patent Application No. 2001-367075 filed on Nov. 30, 2001, the contents of which are herein incorporated by reference.

1. Field of the Invention

The present invention relates to a printing apparatus and an ink cartridge therefor. In particular, it relates to a printing apparatus where a plurality of ink cartridges are detachably mountable, and to an ink cartridge used for such a printing apparatus.

2. Related Art

As one type of a printing apparatus such as an ink jet printer, there is a printing apparatus with a plurality of detachably mountable ink cartridges. Each ink cartridge contains the respective ink, and the printing apparatus executes the printing operation with the supply of ink from the mounted ink cartridge.

With such a printing apparatus, it is necessary to avoid a printing process being interrupted when there is no ink stored in the ink cartridge during printing. From the above perspectives, a control portion provided in a printing apparatus body manages a used amount or residual quantity of ink. Further, there is provided a nonvolatile memory storing information showing the used amount or residual quantity of ink in the ink cartridge. This nonvolatile memory may not contain a lot of information due to miniaturization and decrease of cost. Therefore, after storing information showing the used amount or residual quantity of ink in the memory of the printing apparatus body, only appropriate information is written in the non-volatile memory provided in the ink cartridge.

However, in a case a power supply is suddenly forcedly to be cut off due to such as a plug accidentally disconnecting from a socket or for some other reason, information showing a used amount or residual quantity of ink saved in a memory of a printing apparatus body is eliminated. When such a situation arises, the printing apparatus may not correctly manage the used amount or residual quantity of ink, and there will exist possibility of an occurrence of an inconvenience such as running out of ink during printing.

SUMMARY OF THE INVENTION

The present invention is made in view of the relevant illustrated and other objects, and one object is to provide a printing apparatus which may effectively manage information related to each ink cartridge, and to an ink cartridge for the printing apparatus.

The objects and the features thereof except for the above in the present invention, are made clear by the description of this specification in reference to the appended drawings.

A first aspect of the present invention to accomplish the above objects is a printing apparatus having a cartridge mounting portion where a plurality of ink cartridges with elements into which information may be written are detachably mountable, an accumulating means for accumulating a discharge amount of ink discharged for every ink cartridge mounted on the cartridge mounting portion, and a writing member for writing information into the element, in which the writing member writes information into one or a plurality of elements in at least one ink cartridge selected according to an accumulated result of the accumulating means, out of the plurality of ink cartridges mounted on the cartridge mounting portion.

Further, another aspect of the present invention is an ink cartridge which can contain ink and is detachable from a printing apparatus body, comprising an element into which information can be written; and the information including information showing a used amount or residual quantity of ink contained in the ink cartridge, and information for determining a writing timing of the information showing the used amount or residual quantity into the ink cartridge.

BRIEF DESCRIPTION OF THE DRAWINGS

For a more complete understanding of the present invention and the advantages thereof, reference is now made to the following description taken in conjunction with the accompanying drawings wherein:

FIG. 9 is an explanatory view according to Embodiment 1 for explaining a change in information inside a RAM;

FIG. 10 is an explanatory view according to Embodiment 2 for explaining a change in information inside a RAM;

DETAILED DESCRIPTION OF PREFERRED EMBODIMENTS

Figure 1:
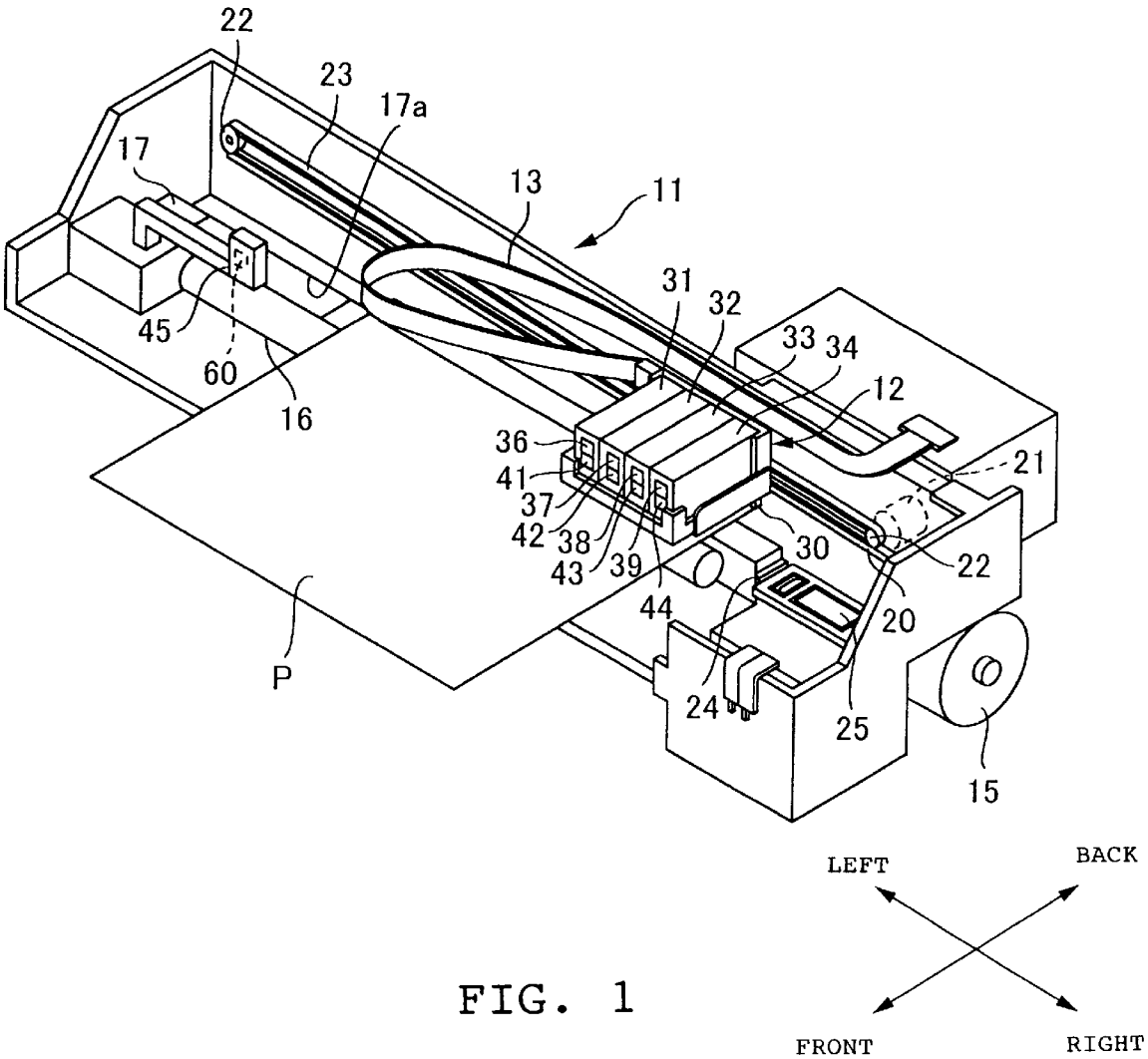
FIG. 1 is a schematic perspective view of an ink jet printer according to Embodiment 1.

From the explanation in this specification and the appended drawings, at least the below matters will become clear.

A printing apparatus comprises a cartridge mounting portion with a plurality of detachably mountable ink cartridges, each having an element into which information can be written, an accumulating means for accumulating a discharge amount of ink discharged for every ink cartridge mounted on the cartridge mounting portion, and a writing member for writing the information into the element; wherein the writing member writes the information into the element in the ink cartridge selected according to an accumulated result of the accumulating means, out of the plurality of ink cartridges mounted on the cartridge mounting portion.

According to this printing apparatus, the writing member writes information into the element in the ink cartridge selected according to the accumulated result of the accumulating means, out of the plurality of ink cartridges mounted on the cartridge mounting portion, so that the information may be written in a short time based on the accumulated result.

Further, in this printing apparatus, one ink cartridge may be selected out of the plurality of ink cartridges mounted on the cartridge mounting portion, according to the accumulated result of the accumulating means.

According to this printing apparatus, one ink cartridge is selected out of the plurality of ink cartridges mounted on the cartridge mounting portion according to the accumulated result of the accumulating means so that the information may be written in a shorter time, based on the accumulated result.

Further, in this printing apparatus, the writing member may write information showing a used amount or residual quantity of ink contained in the ink cartridge into the element in the selected ink cartridge.

According to this printing apparatus, since the writing member writes information showing a used amount or residual quantity of ink contained in the ink cartridge into the element in the selected ink cartridge, based on the accumulated result, the information showing the used amount or the residual amount may be written in a shorter time.

Further, in this printing apparatus, when the writing member writes the information into an element in an ink cartridge, an accumulated value which is the accumulated result of the ink cartridge may be reset.

According to this printing apparatus, when the writing member writes the information into an element in an ink cartridge, the accumulated value of the ink cartridge is reset, so that based on the result accumulated after the writing operation, the information may be written in.

Further, in this printing apparatus, the cartridge mounting portion is movable; and the writing member may conduct a writing operation in a noncontact state into the element, when the cartridge mounting portion is in a predetermined positional relationship with the writing member.

In such a printing apparatus, it is difficult for the writing member to always conduct the writing operation, and the writing member needs to efficiently conduct a writing operation into the element, when the cartridge mounting portion is in a predetermined positional relationship with the writing member. Here, as described above, according to the printing apparatus, it is a structure such that the writing member writes in information into the element in the ink cartridge selected according to the accumulated result of the accumulating means, out of the plurality of ink cartridges mounted on the cartridge mounting portion. Thus, the writing member may write the information in a short time based on the accumulated result, when the cartridge mounting portion is in a predetermined positional relationship to the writing member.

Further, in this printing apparatus, a threshold is provided for every ink cartridge; and when an accumulated value which is the accumulated result of a certain ink cartridge has reached the threshold provided for the ink cartridge, the ink cartridge is selected; and the writing member may write the information into the element in this selected ink cartridge.

According to this printing apparatus, unless the accumulated value of a certain ink cartridge reaches a threshold, the information showing such as the used amount is not written into the element in the ink cartridge, and limiting to a case where the accumulated value of a certain ink cartridge reaches the threshold, the writing member writes the information showing such as the used amount to the element in the ink cartridge, so that information to be written into the element may be suppressed to a bare minimum.

Further, in this printing apparatus, the threshold for every ink cartridge may be set according to a capacity of ink which may be contained in the ink cartridge.

An ink cartridge with a small capacity for containing ink needs to closely manage such as the used amount of ink. According to this printing apparatus, the threshold is set according to the capacity of ink which may be contained in the ink cartridge, so that such as the used amount may be managed according to the capacity of ink which may be contained.

Further, in this printing apparatus, a bidirectional printing with a discharge head which discharges ink is possible; and in a case an accumulated value which is the accumulated result of a certain ink cartridge reaches a threshold provided for the ink cartridge, when the discharge head moves in a direction away from the writing member and discharges ink to print; and if printing data exists which is to be printed by discharging ink whilst the discharge head moves in a direction closer towards the writing member, at least, after printing is conducted by the discharge head moving towards the writing member and discharging ink, the writing member may write in the information.

According to this printing apparatus, when conducting bidirectional printing, the generation of waste time accompanying the writing operation is suppressed.

Further, the above printing apparatus may further comprise a discharge head for discharging ink whilst moving with the cartridge mounting portion, the printing apparatus conducts a flushing operation for discharging ink periodically from the discharge head, and the writing member may write the information into the element in the selected ink cartridge, in relation with the flushing operation.

According to this printing apparatus, since the information is written into the element in the selected ink cartridge, in relation with the flushing operation periodically conducted, an efficient information writing becomes possible.

Further, according to this printing apparatus, the writing member may write the information into the element in the selected ink cartridge, in relation with a flushing operation first conducted after an accumulated value which is the accumulated result of a certain ink cartridge has reached a threshold provided for the ink cartridge.

According to this printing apparatus, since the writing member writes the information into the element in the selected ink cartridge, in relation with a flushing operation first conducted after an accumulated value which is the accumulated result of a certain ink cartridge has reached a threshold provided for the ink cartridge, at an early time after the accumulated value has reached a threshold, the writing member may efficiently write in information.

Further, according to this printing apparatus, a writing position of the writing member and a conducting position of a flushing operation are provided, in order from a printing region side, in a moving direction of the discharge head; and whilst a discharge head is moving towards the conducting position of the flushing operation, for the flushing operation first conducted after an accumulated value which is the accumulated result of a certain ink cartridge has reached a threshold provided for the ink cartridge, the writing member may write the information when the element moving with the discharge head passes the writing position.

According to this printing apparatus, the writing of the information in relation with the flushing operation may be effectively realized.

In this printing apparatus, the element may be written with a plurality sets of information; and the writing member may write only the information showing the used amount or residual quantity out of the plurality sets of information.

According to this printing apparatus, since the writing member writes only the information showing the used amount or residual quantity out of the plurality sets of information, the information may be written in a shorter time, than in a case the writing member writes information including other than such as the used amount.

Further, in this printing apparatus, a plurality of printing modes with different printing speeds may be conducted; and in at least one printing mode out of the plurality of printing modes, even in a case an accumulated value which is the accumulated result of a certain ink cartridge has reached a threshold provided for the ink cartridge, the writing member may not have to conduct the writing operation in relation with a flushing operation first conducted thereafter.

According to this printing apparatus, for example, in a case of such as a printing mode which places priority on the printing speed, the printing speed may be increased by not conducting the writing operation.

Further, in this printing apparatus, one writing member may be provided for a plurality of ink cartridges mounted on the cartridge mounting portion.

According to this printing apparatus, the writing member may only write in information for one element at a time. However, since the writing member writes in information into an element in one of the ink cartridges selected according to the accumulated result of the accumulating means, out of the plurality of ink cartridges mounted on the cartridge mounting portion, write into an element with the highest writing need becomes possible.

Further, in this printing apparatus, in a state the discharge head is positioned in a conducting position of the flushing operation, the writing member may oppose an element provided in any of the ink cartridges out of the ink cartridges mounted on the cartridge mounting portion.

According to this printing apparatus, since the flushing position and the information writing position are in proximity to each other, the write in of information into the element, and the flushing operation may be more effectively related.

Further, in this printing apparatus, the writing members may be respectively provided to the plurality of ink cartridges mounted on the cartridge mounting portion; and the writing member may oppose the respective elements provided in the ink cartridges mounted on the cartridge mounting portion, in a state a discharge head is positioned in a conducting position of a flushing operation.

According to this printing apparatus, in a case the writing member is respectively provided to the plurality of ink cartridges mounted on the cartridge mounting portion; the writing of information into the element, and the flushing operation may be more effectively related.

Further, in this printing apparatus, the writing members may be provided respectively to the plurality of ink cartridges mounted on the cartridge mounting portion; and the writing member conducting writing of the information may be a writing member disposed in a position closest to a printing region.

According to this printing apparatus, since the writing member conducting writing of the information may be a writing member disposed in a position closest to a printing region, even during printing, efficient writing of information becomes possible.

Further, in this printing apparatus, the writing member may read information from the element; the writing member reads an ID information stored in an element in an ink cartridge, when the ink cartridge is mounted on the cartridge mounting portion; and the writing member, after reading the ID information, recognizes each element by the ID information which has been already read, without conducting a reading operation again, and may write the information into each element in the ink cartridge mounted on the cartridge mounting portion.

According to this printing apparatus, since the writing member, recognizes each element by the ID information which has been already read, without conducting a reading operation again, and writes the information into each element in the ink cartridge mounted on the cartridge mounting portion, information may be promptly written, whilst preventing writing of information into other elements by mistake.

Further, in this printing apparatus, the element provided in the ink cartridge is stored with a timing information for determining the writing timing of information showing the used amount or residual quantity into the ink cartridge; and the threshold may be set according to this timing information.

According to this printing apparatus, the threshold may be set in accordance with the ink cartridge mounted on the cartridge mounting portion.

Further, in this printing apparatus, the timing information is a capacity information showing a capacity of ink which may be contained in the ink cartridge, and the threshold may be set according to this capacity information.

According to this printing apparatus, the threshold may be set in accordance with the capacity of the ink cartridge mounted on the cartridge mounting portion.

Further, in this printing apparatus, the timing information is a threshold information showing a threshold according to the capacity of ink which may be contained in the ink cartridge, and the threshold may be set according to this threshold information.

According to this printing apparatus, the printing apparatus may set the threshold, in accordance with the threshold information of the ink cartridge mounted on the cartridge mounting portion.

Further, this printing apparatus may further comprise a discharge head for discharging ink whilst moving with the cartridge mounting portion, the printing apparatus conducts a flushing operation for discharging ink periodically from the discharge head, and the writing member may write the information into the element in the selected ink cartridge, in relation with the flushing operation.

According to this printing apparatus, in relation with the flushing operation periodically conducted, since the information may be written into the element in the selected ink cartridge, efficient writing of information becomes possible.

Further, in this printing apparatus, the writing member may select one cartridge out of the plurality of ink cartridges mounted on the cartridge mounting portion, when conducting the flushing operation, according to an accumulated result of the accumulating means.

According to this printing apparatus, since one cartridge out of the plurality of ink cartridges mounted on the cartridge mounting portion is selected, according to an accumulated result at the time of conducting the flushing operation, the writing operation into an element of an ink cartridge with the highest need may be conducted.

Further, there is provided an ink cartridge which may contain ink and detachable from a printing apparatus body, comprising an element which may write information; and the element may write information showing a used amount or residual quantity of ink contained in the ink cartridge, and information for determining a writing timing of the information showing the used amount or residual quantity into the ink cartridge.

Further, in this ink cartridge, the element may write the information in a noncontact state.

Further, in this ink cartridge, information for determining the writing timing may be capacity information showing a capacity of ink which may be contained in the ink cartridge.

Further, in this ink cartridge, when the ink cartridge is mounted on a cartridge mounting portion of a printing apparatus body having the cartridge mounting portion with a plurality of detachably mountable ink cartridges, an accumulating means for accumulating a discharge amount of ink discharged for every ink cartridge mounted on the cartridge mounting portion, and a writing member for writing information into the element, the capacity information is read by the printing apparatus body, and a threshold based on the capacity information is set; and when an accumulated value which is the accumulated result of the ink cartridge reaches the threshold, the element may be written with information showing the used amount or residual quantity of the ink by the writing member.

Further, in this ink cartridge, information for determining a writing timing is a threshold information showing a threshold according to a capacity of ink which may be contained in the ink cartridge.

Further, in this ink cartridge, the element may be stored with an ID information inherent to the element.

Further, in this ink cartridge, the element is recognized by the ID information, and then the element may be written with information.

=Embodiment 1=

===Summary of Printing Apparatus===

Figure 2:
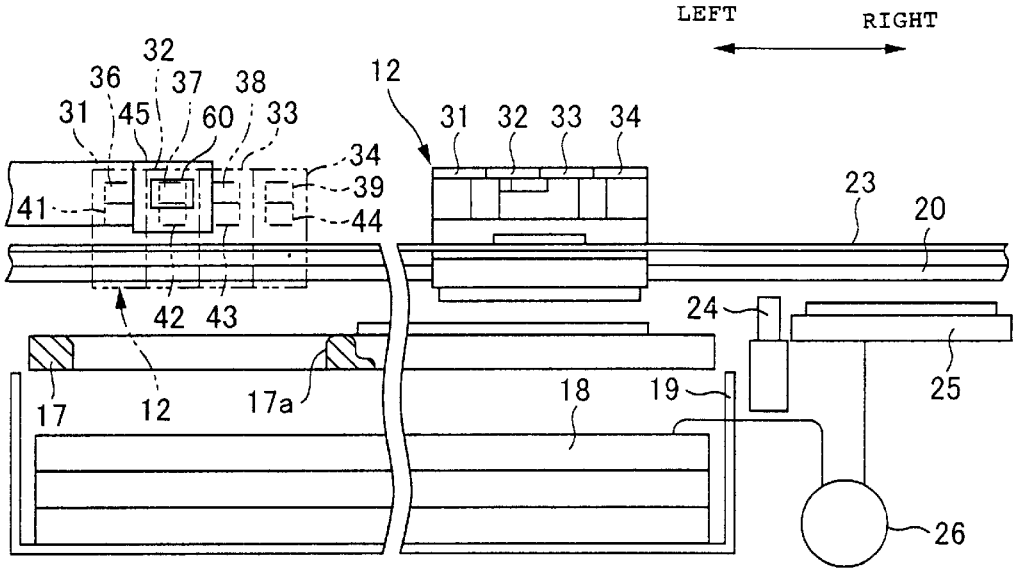
FIG. 2 is a schematic front view of the ink jet printer according to Embodiment 1.
Figure 3:
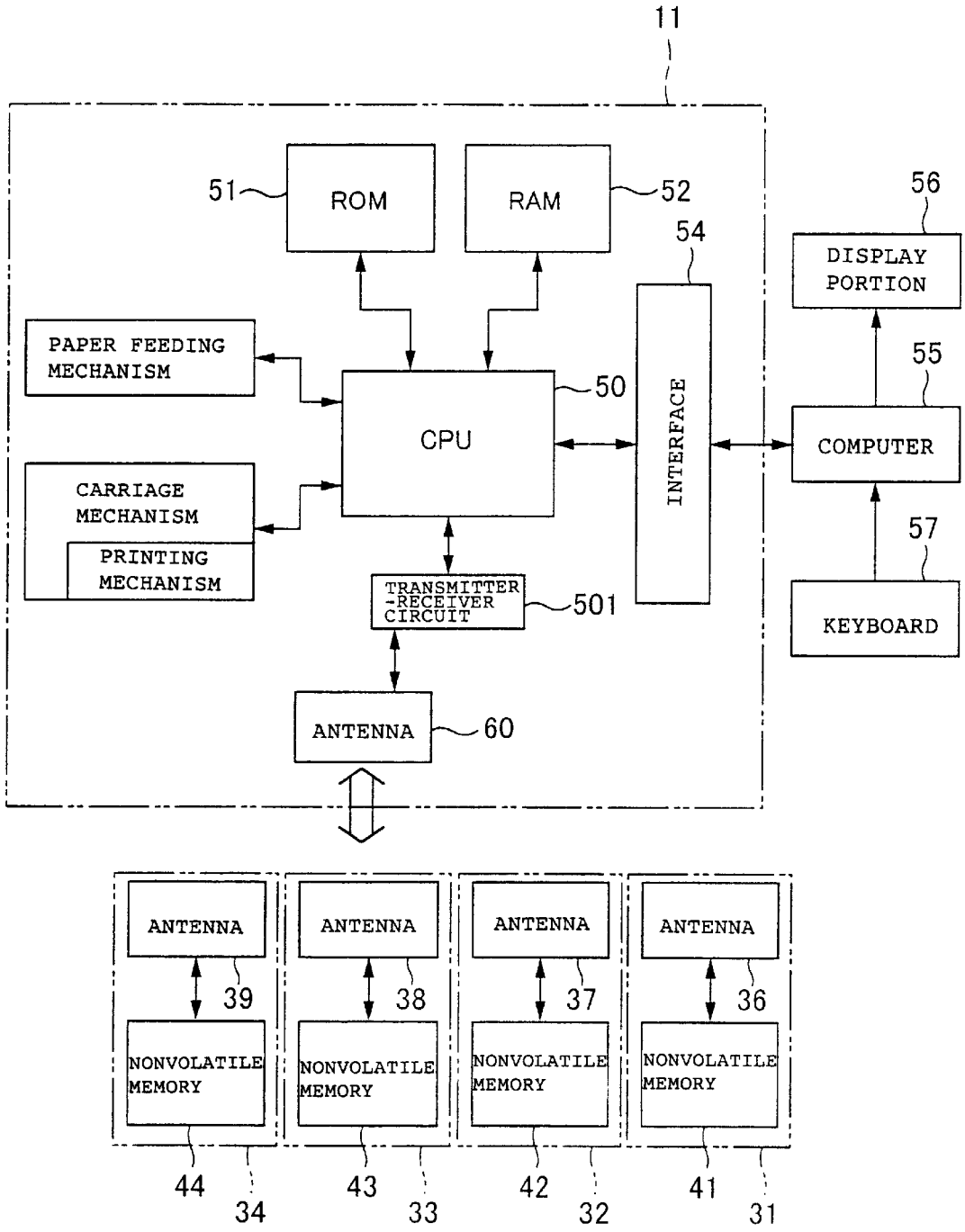
FIG. 3 is a block diagram showing a circuit structure of the ink jet printer according to Embodiment 1.

First, an ink jet printer as a printing apparatus is given as an example, and by referring to FIGS. 1 to 3, the summary thereof will be described. FIG. 1 is a schematic perspective view of an ink jet printer. FIG. 2 is a schematic front view of an ink jet printer. FIG. 3 is a block diagram showing a circuit structure of an ink jet printer.

As shown in FIG. 1, the ink jet printer as the printing apparatus comprises a printer body 11 which is a printing apparatus body, and a carriage 12 which may reciprocate in a width direction thereof (left to right in the figure). The printer body 11 is provided with a paper feed mechanism for conveying a printing paper P, and a carriage mechanism for operating the carriage 12. The paper feed mechanism comprises a paper feed motor 15, a paper feed 9 roller 16, and other rollers not shown. By driving this paper feed motor 15, the paper feed roller 16 and other rollers not shown rotate, and the conveyance of the printing paper P is conducted.

The carriage mechanism comprises a guide member 20 installed in parallel with the axis of the paper feed roller 16, a carriage motor 21, and a timing belt 23 provided in between a pair of pulleys 22. With this carriage mechanism, the carriage 12 engaged to the timing belt 23, is made movable in the width direction of the printing paper P along the guide member 20.

The carriage 12 is provided with a recording head 30 as a discharge head for discharging ink drops on the printing paper P, and is also mounted with ink cartridges (hereinafter referred to also as "cartridge") 31, 32, 33, and 34 containing ink in the respective colors, for example, black, cyan, magenta, and yellow, in a detachable manner. The carriage 12 has a cartridge mounting portion 80 (refer to FIG. 4B) with a plurality of detachably mountable cartridges. The recording head 30 receives a supply of ink from the cartridges 31 to 34 which are held in the cartridge mounting portion 80.

Further, the respective cartridges 31 to 34 are provided at each front surface side with a storage unit having antennas 36, 37, 38, and 39, and elements 41, 42, 43, and 44 in which various information can be written. The elements 41, 42, 43, and 44 may be written with various information, and moreover, may store the written information. Further, each of these elements 41, 42, 43, and 44 has a nonvolatile memory (EEPROM), and are connected to antennas 36, 37, 38, and 39, respectively. These cartridges 31 to 34 are detachably mountable on the cartridge mounting portion 80, and in a case the ink is consumed, the expiry date has passed, the user wants to change to a different color cartridge, and the like, the user may appropriately change the cartridge. Note that, the details of the cartridges 31 to 34 and the storage unit will be described later on.

The recording head 30 is connected to a control portion 50 described later, via a flat cable 13, and controls such as a size of the discharged ink drop.

A platen 17 is disposed in between the paper feed motor 15 and the paper feed roller 16. One end portion of the platen 17 (which is in a non printing region) is provided with a hole 17*a*. Below this hole 17*a* is disposed an ink absorbing material 18, and this ink absorbing material 18 is placed in a waste ink tank 19 disposed in parallel with the platen 17. Further, at the side of the other end portion of the platen 17, there is provided a known wiping member 24 and a known capping means 25. This capping means 25 is connected to the ink absorbing material 18 via a suction pump 26.

As shown in FIG. 2, above the hole 17*a* of the above platen 17, there is provided a transmitter-receiver portion 45, and at the center of the transmitter-receiver portion 45, there is provided an antenna 60 as a writing member. This antenna 60 is constructed so that when an ink discharge mouth (not shown) of the recording head 30 is positioned above the hole 17*a* of the platen 17 (hereinafter referred to as "flushing position"), it opposes the antennae 37 of the cartridge 32, and conducts transmitting and receiving in a noncontact state with the antenna 37. Further, the antenna 60 of the transmitter-receiver portion 45 is connected via a cable or the like not shown, and via a transmitter-receiver circuit 501 of the printer body 11 to the control portion 50.

As shown in FIG. 3, the printer body 11 comprises a central processing unit (CPU) as the control portion 50 for controlling the operation of the entire printer. This control portion 50 is connected with a read only memory (ROM) 51 storing a program and a random access memory (RAM) 52 temporarily storing such as working data.

The control portion 50 is connected with such as a carriage mechanism including a printing mechanism and a paper feed mechanism, and outputs an operation signal to the respective mechanisms. Further, the control portion 50 accumulates the discharge amount of ink discharged from the recording head 30 for every cartridge, and saves the accumulated result in a RAM 52.

Further, the control portion 50 is connected with the antenna 60 via the transmitter-receiver circuit 501, and attribute data of ink or the like are inputted to or outputted from the respective nonvolatile memories 41 to 44 via this antenna 60 and the antennas 36 to 39.

Further, the control portion 50 in the printer body 11 is connected with an external computer 55 via an interface 54, and exchange of such as printing data with this computer 55 is conducted. Further, the computer 55 is connected with a display 56 such as a display device and a keyboard 57 for inputting various data.

===Structure of Ink Cartridge and Cartridge Mounting Portion===

In the inkjet printer constructed in this way, a basic structure of the ink cartridges 31 to 34 are in common. Here, referring to FIGS. 4 and 5, an ink cartridge 31 for a black color is given as an example, and the structure of the ink cartridge and a structure for inserting this cartridge to the printer body 11 are explained.

Figure 4A:
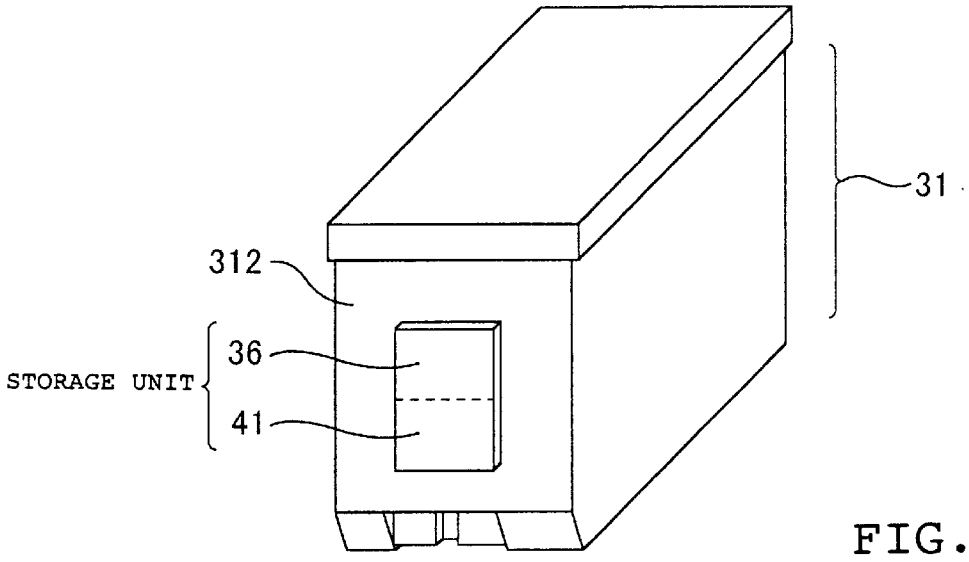
FIGS. 4A and 4B are perspective views of a schematic structure showing an ink cartridge and a cartridge mounting portion of a printer body 11.
Figure 4B:
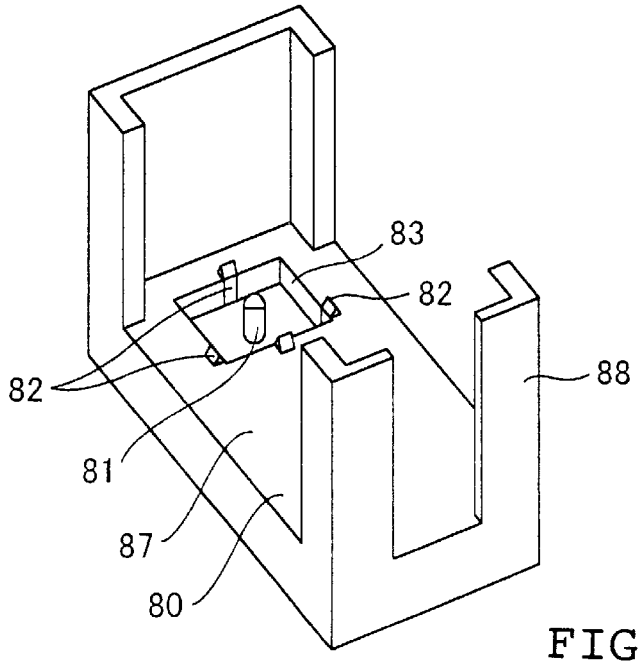
Figure 5:
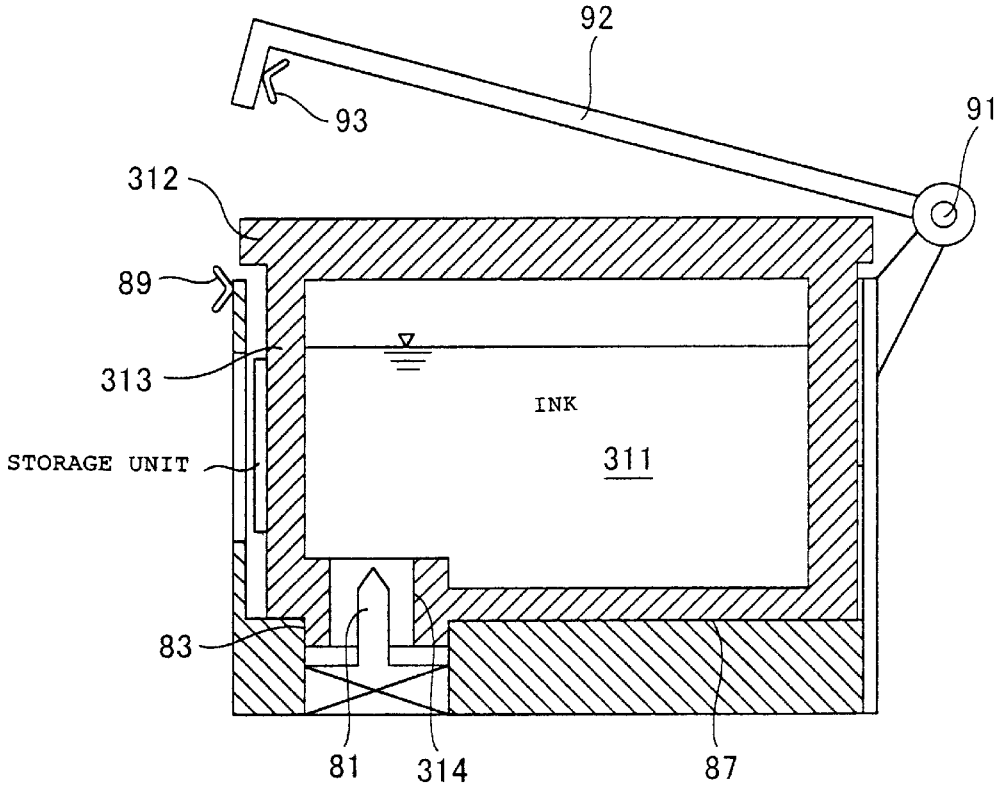
FIG. 5 is a cross-section view showing an internal structure of the ink cartridge, an internal structure of a cartridge mounting portion on the carriage 40, and showing state of holding a cartridge in a cartridge mounting portion.

FIG. 4 is a perspective view showing an ink cartridge and a schematic structure of the cartridge mounting portion of the printer body 11. FIG. 5 is a cross-section view showing an internal structure of this ink cartridge, an internal structure of a cartridge mounting portion on the carriage 40, and shows a state of inserting of the cartridge to the cartridge mounting portion.

In FIG. 4, the ink cartridge 31 comprises a synthetic resin cartridge body 312 structuring an ink containing portion 311 for containing ink inside, and a storage unit provided on a front surface frame portion 313 of the cartridge body 312. This storage unit delivers various data with the printer body 11, when the ink cartridge 31 is held in the cartridge mounting portion 80 of the printer body 11.

On the other hand, the cartridge mounting portion 80 is disposed with a needle 81 facing upwards at the bottom 87 where the ink cartridge 31 is to be inserted. The periphery of this needle 81 is made into a recess for receiving an ink supply portion 314 formed in the ink cartridge 31. The inner wall of this recess 83 is formed with three cartridge guides 82.

Next, a procedure for installing the ink cartridge 31 in the cartridge mounting portion 80 is explained. First, the ink cartridge 31 is disposed in the cartridge mounting portion 80. A back wall 88 of the cartridge mounting portion 80 is attached with a fixed lever 92 via a support shaft 91, and when the fixed lever 92 is lowered so as to cover the ink cartridge 31, the ink cartridge 31 is pushed downwards and the ink supply portion 314 fits in the recess 83, and the needle 81 pierces the ink supply portion 314 to allow ink supply.

Further, when the fixing lever 92 is lowered, a stopping portion 93 formed at a tip end of the fixing lever 92 engages with an engaging part 89 formed in the cartridge mounting portion 80, and the ink cartridge 31 is fixed.

The structure of the ink cartridge 31 is basically similar to that of other ink cartridges, and therefore the explanation thereof will be omitted.

===Structure of Storage Unit===

Figure 6A:
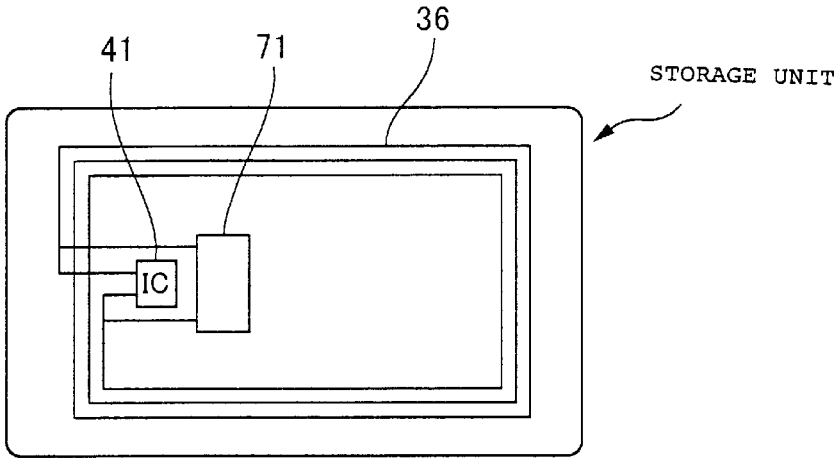
FIGS. 6A and 6B are views for explaining a structure of a storage unit.
Figure 6B:
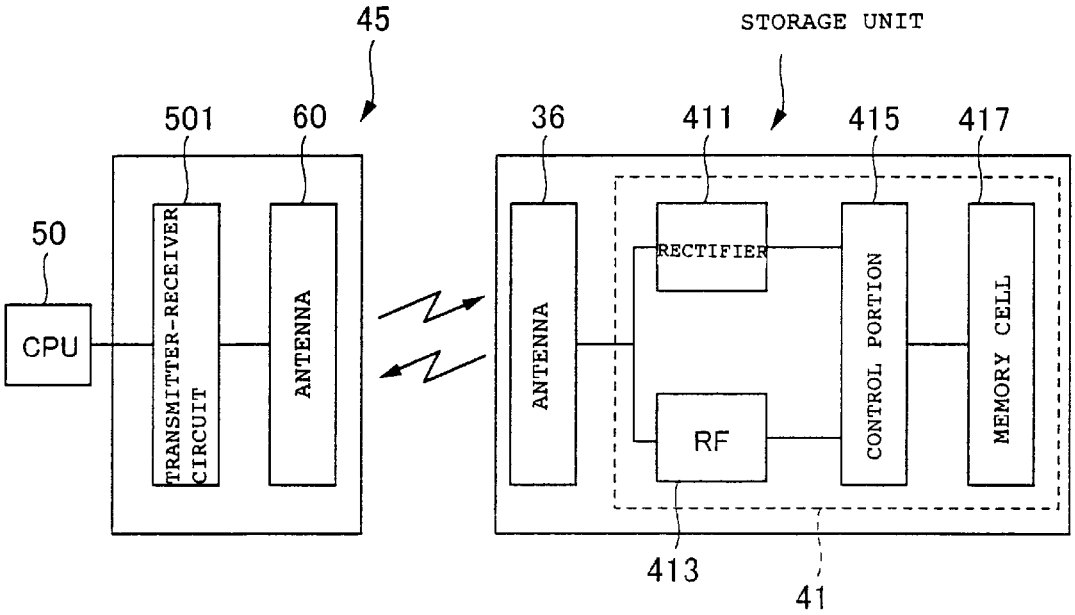

Next, by referring to FIG. 6 the structure of the storage unit is explained including a data transmitter-receiver structure. FIG. 6A is a plan exploded view showing the structure of the storage unit. FIG. 6B is a block diagram explaining an internal structure of the storage unit and a transmitter-receiver portion 45.

If the storage unit and the antenna 60 of the transmitter-receiver portion 45 are in a predetermined positional relationship, for example within a distance of 10 mm from each other, information is transmittable and receivable in a noncontact state from each other. This storage unit is extremely small and thin as a whole, and may be adhesive at one side as a sticker so that it may attach to an object. It is also called such as a memory tag, and many varieties are commercially available. Note that, a storage unit of an ink cartridge other than the ink cartridge 31 is also a similar structure, and thus explanation is omitted.

The storage unit is a plastic film mounted with a noncontact IC chip as an element 41, a resonant capacitor 71 formed by etching a metallic film, and a flat coil as an antenna 36, which is covered by a transparent coversheet.

The transmitter-receiver portion 45 has a coil as an antenna 60, and a transmitter-receiver circuit 501 connected to the control portion (CPU) 50 of the printer body 11, and receives a supply of electric power from a power unit of the printer body 11.

The element 41 of the storage unit has a rectifier 411, a signal analysis portion RF (Radio Frequency) 413, a control portion 415, and a memory cell 417. The memory cell 417 is a nonvolatile memory which may be electrically read by such as a NAND type flash ROM, and stores written information, and may read the stored information from the outside.

The antenna 36 of the storage unit and the antenna 60 of the transmitter-receiver portion 45 are in communication with each other, and read such as ID information saved in the memory cell 417 and write into the memory cell 417. Further, a high frequency signal generated in a transmitter-receiver circuit 501 of the transmitter-receiver portion 45 is induced as a high frequency magnetic field via the antenna 60. This high frequency magnetic field is absorbed through the antenna 36 of the storage unit, and becomes a DC power source driving each circuit within an IC chip 41 which is rectified by a rectifier 411.

The memory cell 417 of the element 41 is stored with an inherent information of each storage element, such as a serial number of an element, namely an ID information. This ID information data may be written processed at the time of factory manufacturing of the storage element. This ID information is read by the transmitter-receiver portion 45 at the printer 10 body side, so that the respective elements 41, 42, 43, and 44 may be recognized.

Further, the memory cell 417 may be written in with information showing the used amount or residual quantity of ink contained in the ink cartridge. The information may be read at the printer body 11 side, and when there is only a small residual quantity left a warning may be given to the user.

Further, the memory cell 417 may be written with information for determining the writing timing of information showing the used amount or residual quantity into the ink cartridge. As information for determining the writing timing of information showing the used amount or residual quantity into the ink cartridge, in this embodiment, a capacity information of ink which may be contained in the ink cartridge 31 attached with an element 41 is used. In this way, the printer body 11 reads in the capacity information from the element 41, for example, sets a threshold as 1% of the capacity information, and it becomes possible to construct so that when the accumulated value of the discharge amount of ink of the ink cartridge 31 reaches this threshold, the information showing the used amount or residual quantity may be written into the element 41.

Further, as information for determining the writing timing of information showing the used amount or residual quantity into the ink cartridge, a threshold information showing a threshold according into a capacity of ink which may be contained in the ink cartridge 31 attached with an element 41 may be used. Threshold information may be, for example, 1% of the capacity of ink, or the like. In this case, a structure is possible where the printer body 11 reads this threshold information from the element 41, and when the accumulated value of the discharge amount of ink of the ink cartridge 31 reaches this threshold, the information showing the used amount or residual quantity may be written into the element 41.

Further, the memory cell 417 of the element 41 may include other than such information, a color data for recognizing the cartridge, a manufacturing information of the ink cartridge attached with the relevant element 41, information related to an expiry period or the like. These information are read at the printer body 11 side, and through comparing process of the expiry data with the present time, when the end of expiry period of the ink cartridge is near, a warning may be given to a user.

===Operation of Ink Jet Printer===

Figure 7:
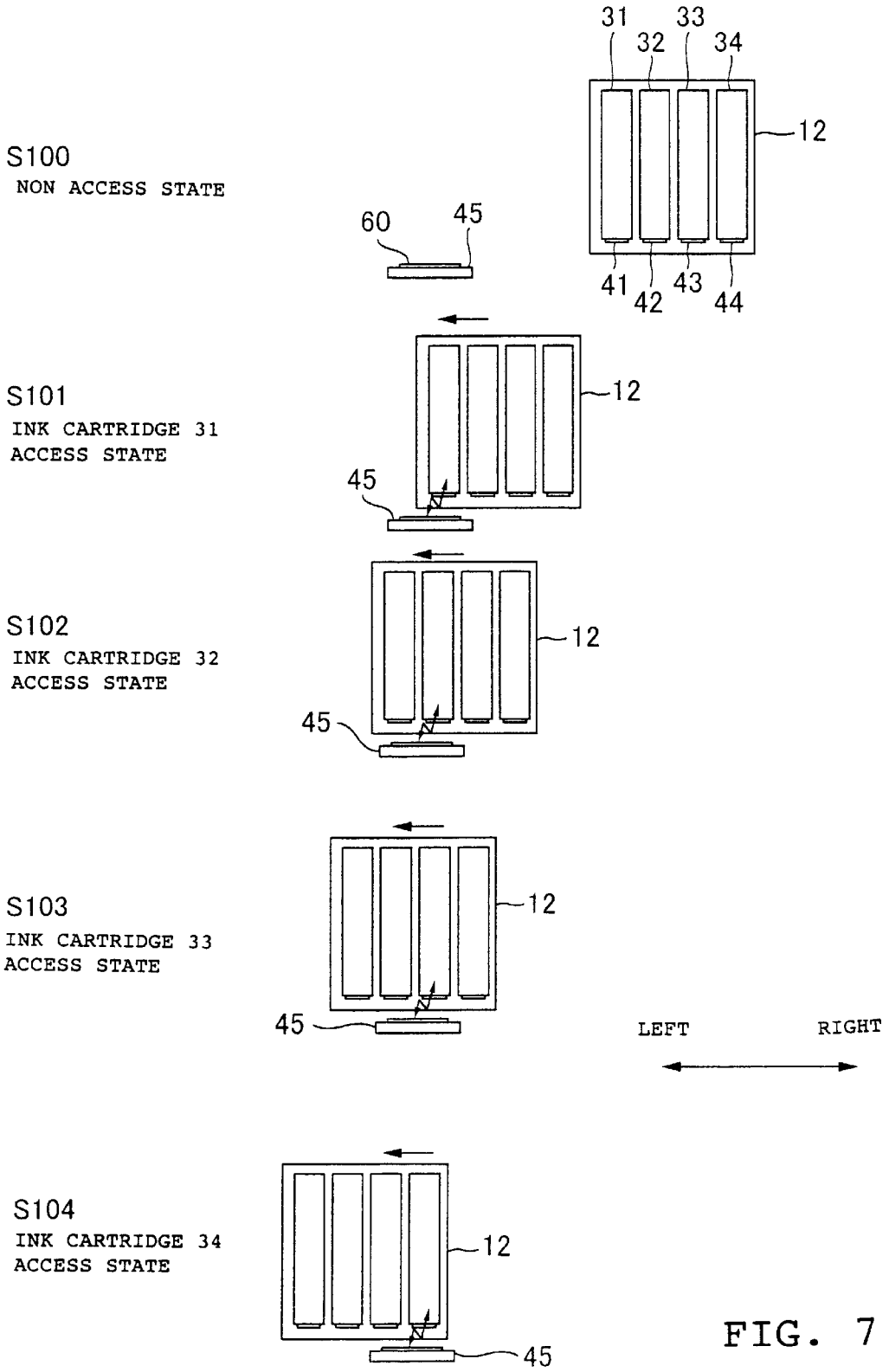
FIG. 7 is a view showing an operation sequence of a carriage 12 (and ink cartridges 31 to 34) when a transmitter-receiver portion 45 reads an ID information stored in elements 41 to 44.
Figure 8:
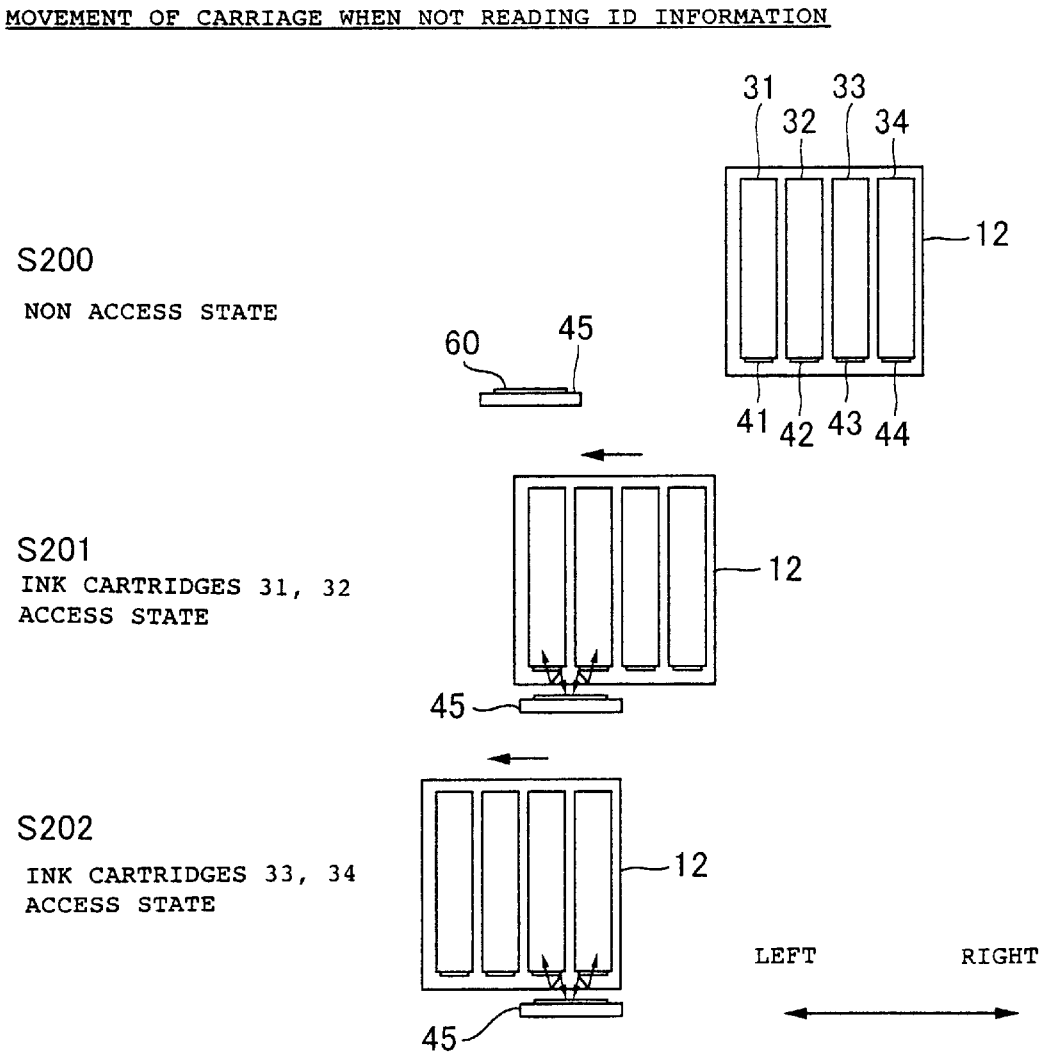
FIG. 8 is a view showing an operation sequence of a carriage 12 (and ink cartridges 31 to 34) when a transmitter-receiver portion 45 reads information other than an ID information stored in elements 41 to 44.

Next, an operation of the above printer is explained referring to FIGS. 7 to 9.

When the ink cartridges 31 to 34 are set in the carriage 12, first the carriage 12 is moved towards a flushing position. Then, from the elements 41 to 44 provided in the cartridges 31 to 34, the ID information stored in each element is read by the printer body 11 via the antennas 36 to 39 and the antenna 60 of the transmitter-receiver portion 45. First, referring to FIG. 7, the reading process of this ID information is described.

<<<Reading process of ID information>>>

FIG. 7 is a diagram showing an operation sequence of the carriage 12 (and the ink cartridges 31 to 34) at the time the transmitter-receiver portion 45 reads the ID information stored in the elements 41 to 44.

The antenna 60 provided in the transmitter-receiver portion 45 of this embodiment is of a size so as to oppose a disposed surface of approximately two of the elements of the ink cartridges 31 to 34 (and the elements 41 to 44 provided thereof respectively). In a case the antenna 60 stops the carriage 12 so that it is positioned at just the center of an element and an adjacent element thereof, data may be transmitted and received with both elements. The transmitter-receiver portion 45 conducts reading or writing of ID information subsequently, to the left end in the figure, namely, from the element 41 towards the element 44 at the right end.

First, in a non-access state (s100) where the transmitter-receiver portion 45 is not in access with any of the elements 41 to 44, the carriage 12 is positioned further to the right of the left side non printing area provided with the transmitter-receiver portion 45, and may not access the elements of any of the ink cartridges.

Next, in an access state of the ink cartridge 31 (s101), the carriage 12 moves to a left side non-printing region, and stops at a position where data is transmittable and receivable with the transmitter-receiver portion 45 and just the left end ink cartridge 31. Namely, near the right end of the antenna 60 of the transmitter-receiver portion 45 is in a position opposing the periphery of the center of the element 41, and in this position, the transmitter-receiver portion 45 is too far from the element 42 of the ink cartridge 32 for data transmitting and receiving. At this stopping position, first the ID information recorded in the element 41 is read.

Next, the carriage 12 is stopped at a position where the carriage 12 is moved to the left for a one cartridge portion, and the ID information reading of the element 42 of the ink cartridge 32 is conducted (s102). At this stopping position, the element 41 may also be accessed, so that in order to prevent interference of data, the ID information read command sent from the transmitter-receiver portion 45 to the element 42 is accompanied with the ID data of the already read element 41. Using the ID information of this element 41, recognition is conducted at the element 41 and 42 side, and ID information from the element 42 may be correctly read.

Thereafter, as similarly, the reading operation of the elements 43 and 44 of the ink cartridges 33 and 34 are subsequently conducted (s103, s104). After reading the ID information of the element 44 (s104), the carriage 12 is returned to a position such as a right non-printing region, and the present ID information reading process is completed.

In this way, all the ID information of the respective elements 41 to 44 are obtained, so that the alignment thereof may be recognized at the printer body 11. Namely, at the most left side, there is arranged the ink cartridge 31 corresponding to the ID information read by the element 41, and at the position adjacent to the right side is disposed the ink cartridge 32 corresponding to the ID information read from the element 42, thus the alignment order in the carriage 12 of all the ink cartridges 31 to 34 is stored.

<<<Reading process of Information other than ID information>>>

Next, by utilizing information related to the relationship of the ID information grasped by the above steps and the alignment order of the ink cartridges 31 to 34, the reading operation of information other than the ID information recorded in the elements 41 to 44 are described. FIG. 8 is a diagram showing the operation sequence of the carriage 12 (and the ink cartridges 31 to 34) when reading information other than ID information recorded in the elements 41 to 44.

First, in a non-access state (S200) where the transmitter-receiver portion 45 is not in access with any of the elements 41 to 44, the carriage 12 is positioned at the right further from the left side non-printing region where the transmitter-receiver portion 45 is provided, and may not access the elements 41 to 44 of any of the ink cartridges 31 to 34.

Next, in the access state (s201) of the ink cartridges 31 and 32, the carriage 12 moves to the left side non-printing region, and the transmitter-receiver portion 45 stops at a position where data is transmittable and receivable, to the left end of the ink cartridge 31 and the adjacent ink cartridge 32. Namely, the periphery of the center of the antenna 60 of the transmitter-receiver portion 45, is in a position opposing the periphery in between the element 41 and 42, and in this position, the transmitter-receiver portion 45 may transmit and receive data with both elements 41 and 42 of the ink cartridges 31 and 32.

At this stopping position, a respective data reading command is sent to the elements 41 and 42. At that time, the element 41 is accompanied with ID information of an already read element 41. The element 41 which received this command, confirms that the accompanying ID information is definitely that of the element 41 itself, and sends back the information other than the requested ID information to the transmitter-receiver portion 45. The reading process to the element 42 is similarly conducted.

Next, the carriage 12 is stopped where it has been moved by two ink cartridge portions to the left, and data reading is conducted to the elements 43 and 44 of the ink cartridges 33 and 34 (s202). At this stopping position, similarly to the reading process to the above elements 41 and 42, the ID information of the elements 43 and 44 are used to certainly recognize the respective elements 43 and 44, and to read the information other than the respective ID information.

In this way, the carriage 12 is stopped at a place where its two elements may be accessed at once, and by reading information other than ID information, the movement/position determining operation of the carriage 12 may be performed in two steps. It is possible to move for one element and determine the position, as well as to read the information stored in the element one by one. However, the present embodiment achieves fewer movements and position determining operations, so that time taken for the entire reading process may be shortened, and thus is more preferable.

With the above process, the used amount (hereinafter referred to as "initial used amount") at the time the cartridge is mounted on the cartridge mounting portion 80, an ink color information, an expiry period information, or the like for every ink cartridge is read by the printer body 11, and stored in such as the RAM 52.

When the above process is completed, the carriage 12 moves to a position where a capping means 25 is provided, and waits in a capped state.

<<<Printing and Writing Process of Used Amount/Residual Quantity>>>

Thereafter, in order to print an image or a character on a printing paper P, data of the image and the character are sent from a computer 55 via an interface 54 to the printer body 11. Then, first a control portion 50 of the printer body 11 sends a signal to the paper feed mechanism and starts feeding the printing paper P. Next, the control portion 50 gives a signal to the carriage mechanism, and moves the carriage 12 whilst discharging ink drops according to the image and character from the recording head 30. At this time, the control portion 50 stores the amount of ink drops of the respective cartridges and the discharged number of times thereof in the RAM 52. In this way, the ink discharge amount discharged towards the printing paper P which is the printing medium, is accumulated for every ink cartridge mounted on the cartridge mounting portion 80 of the carriage 12.

After the carriage 12 is reciprocated for a predetermined number of times along the guide member 20, the control portion 50 moves the carriage 12 to a flushing position at the left side non-printing region, and then gives a signal to the carriage mechanism, discharges ink from the recording head 30 for a predetermined amount, to conduct the so-called flushing operation. This flushing operation is an operation conducted in aim to prevent such as blocking of an ink discharge nozzle of the recording head 30.

Simultaneously, the control portion 50 selects the cartridge with the largest amount of ink used amount from data of the RAM 52. If the used amount of ink contained in the respective cartridges 31 to 34 until this time, namely, the accumulated result of the ink discharge amount which is the accumulated value, is as shown in FIG. 9, for example, 54, 81, 32, and 13 (picoliters) respectively, the cartridge 32 with the most used amount is selected.

Then, in a case the antenna 37 and the antenna 60 are not in a positional relationship where a signal may be transmitted and received, the control portion 50 moves the carriage 12 along the guide member 20, and writes the value of the ink used amount at this time accumulated with the initial used amount to the element (nonvolatile memory) 42 of the cartridge 32 via the antenna 60 and the antenna 37, as information showing the used amount. Further, the initial used amount recorded in the RAM 52 is updated to a value where the ink used amount at this time is added with the initial used amount. At this time, as shown in FIG. 9 as "after first time of flushing", the control portion 50 resets data of the used amount of the cartridge 32 stored in the RAM 52. Namely, the control portion 50 resets the accumulated value of the cartridge 32.

After such an operation is completed, the control portion 50 again gives a signal to the carriage mechanism, and resumes printing. Then, the ink used amount during this printing is accumulated in the RAM 52.

It should be noted that, this used amount of ink includes the ink amount used in the previous flushing operation. Then, after the carriage 12 has reciprocated for the predetermined amount of times, the carriage 12 is again moved to the flushing position, to conduct the flushing operation. For example, as described as "before second time of flushing", in a case that the used amount of each ink is 112, 78, 59, and 41, the control portion 50 selects the cartridge 31 with the most used amount.

Then, in a case the antenna 36 and the antenna 60 are not in a positional relationship where a signal may be transmitted and received, the control portion 50 moves the carriage 12 along the guide member 20, and writes the value of the ink used amount at this time added with the initial used amount into the element (nonvolatile memory) 41 via the antenna 60 and the antenna 36 as information showing the used amount. Further, the initial used amount stored in the RAM 52 is updated to a value of the ink used amount at this time added with the initial used amount. Further, the control portion 50 resets the used amount of the cartridge 31 stored in the RAM 52. Note that, the ink amount of the respective cartridges 31 to 34 used from the first time of the flushing operation until before the second time of the flushing operation is 58, 78, 27 and 28 (picoliters).

As described above, the ink jet printer has the recording head 30 which discharges ink whilst moving with the cartridge mounting portion 80, and conducts a flushing operation for discharging ink periodically from a discharge head 30, and the antenna 60 which is a writing member, in relation with the flushing operation, writes information showing the used amount into the elements provided in the selected cartridge. More specifically, during printing, the control portion 50 accumulates the used amount of ink contained in the respective cartridges 31 to 34, and stores it in the RAM 52. Then, the control portion 50 conducts the flushing operation, every time the carriage reciprocates for a predetermined number of times when printing, and the information showing the used amount of ink are written into the elements 41 to 44 of the cartridges 31 to 34 which are determined to have the most ink consumption amount.

Then, the used amount of ink stored in the RAM 52 of the cartridges 31 to 34, which are provided with the respective elements 41 to 44 which are written with the information, is reset.

Note that, when there are a plurality of papers for printing, every time the printing of each page is completed, the carriage 12 is moved to the flushing position and the information is written into the elements 41 to 44, in a descending order of ink usage used amount of each ink cartridge, and the used amount of ink stored in the RAM 52 is reset.

Further, when writing is conducted to the respective elements 41 to 44, the ID reading operation does not have to be conducted again, and data writing command is sent to the elements. At that time, the respective elements 41 to 44 are accompanied with the already read ID information of the respective elements. The element which receives this command confirms that the accompanied ID information is definitely the ID information of the element itself, and sends back the information other than the requested ID information to the transmitter-receiver portion 45.

The antenna 60 as the writing member recognizes the respective elements by the ID information which has been already read, and writes the information into each element provided in the ink cartridge mounted on the cartridge mounting portion 80, so that information is prevented from being mistakenly written in other elements, and writing may be promptly conducted.

Further, writing into the element may be conducted in a state where the carriage 12 is stopped, and a state where the carriage 12 is moving.

Further, from the point of view of writing the information in a short time, when writing the information showing the used amount into the element, it is preferable to write only the information showing the used amount or residual quantity out of the plurality of information.

=Embodiment 2=

Next, Embodiment 2 is described. In Embodiment 2, a used amount or residual quantity writing process differ from that of Embodiment 1. The other structures are similar to that of Embodiment 1, and differing points will mainly be described.

In Embodiment 1, after a carriage 12 reciprocates for a predetermined number of times along a guide member 20, the carriage 12 is moved to a flushing position, and conducts namely a flushing operation. When conducting this flushing operation, a control portion 50 selects a cartridge with the most ink used amount from data of a RAM 52.

In Embodiment 2, after printing starts, the control portion 50 selects a cartridge when data of the RAM 52 reaches a threshold. The details are described as below.

In this embodiment, an "information reading process of other than ID information" as described in Embodiment 1 is conducted, and at that time, a capacity information of ink which may be contained in an ink cartridge attached with each element, as information for determining a writing timing of information showing a used amount or residual quantity into the ink cartridge, which is information other than the ID information stored in the respective elements 41 to 44, is read by a printer body 11. The control portion 50 stores a value of 1% of the capacity information as a threshold for every ink cartridge in the RAM 52. In this embodiment, the capacity information of ink cartridges 32, 33, and 34 are equal, and the capacity information of the ink cartridge 31 containing the black ink is larger than the capacity information of the ink cartridges 32, 33, and 34. Thus, as shown in FIG. 10, for the ink cartridges 32, 33, and 34, the threshold is set as 50 (picoliters), and for the ink cartridge 31, the threshold is set as 70 (picoliters).

<<<Printing and Used Amount/Residual Quantity Writing Process of this embodiment >>>

In order to print an image or a character to a printing paper P, data of the image and the character are sent from a computer 55 to the printer body 11 via an interface 54. Then, first the control portion 50 of the printer body 11 gives a signal to the paper feed mechanism, and starts feeding the printing paper P. Next, the control portion 50 sends a signal to a carriage mechanism, and moves the carriage 12, whilst ink drops are discharged according to the image and the character from a recording head 30 thereof. At the same time, the control portion 50 stores the amount of ink drops of each cartridge and a number of times of discharge to the RAM 52. Namely, for every ink cartridge held in a cartridge mounting portion 80 of the carriage 12, the discharge amount of ink discharged towards the printing paper P which is the printing medium is accumulated.

It is judged whether an accumulated value which is an accumulated result has reached the threshold or not for every ink cartridge. If the control portion 50 determines that the accumulated value of any of the ink cartridges has reached the threshold, the control portion 50 selects such a cartridge.

For example, as shown in FIG. 10, when the accumulated value of the ink cartridge 31 reaches 70 (picoliters) which is the threshold, of the ink cartridge 31, the ink cartridge 31 is selected. Note that, the used amount of ink stored in the respective cartridges 31 to 34 at the time the ink cartridge 31 is selected, namely, the accumulated value which is the accumulated result of the ink discharge amount is, 70, 38, 21, and 15 (picoliters), respectively, as shown in FIG. 10.

Then, the control portion 50 moves the carriage 12 to the antenna 60 of the transmitter-receiver portion, and with the antenna 36 and the antenna 60 in a positional relationship where signals are transmittable and receivable, via the antenna 60 and the antenna 36, a value of a used amount of ink at this time added with an initial used amount is written as information showing the used amount into the element (nonvolatile memory) 41 of the cartridge 31. Further, the initial used amount stored in the RAM 52, is updated to a value of the used amount of ink at this time added with the initial used amount. Further, as shown in FIG. 10 as "after first time of writing", the control portion 50 resets data of the used amount of the cartridge 31 stored in the RAM 52. Namely, the control portion 50 resets the accumulated value with respect to the cartridge 31.

When such an operation is completed, the control portion 50 again gives a signal to the carriage mechanism, and resumes printing. Then, the discharge amount of ink discharged towards the printing paper P which is the printing medium during this printing, is accumulated for every ink cartridge.

The accumulated value which is the accumulated result is judged whether it has reached the threshold or not for every ink cartridge. When the control portion 50 determines that the accumulated value of any of the ink cartridges has reached the threshold, such an ink cartridge is selected.

For example, as described in FIG. 10 as "second time to reach threshold", when the accumulated value of the cartridge 32 reaches the threshold of the cartridge 32 which is "50 (picoliters)", the control portion 50 selects the cartridge 32.

Then, the control portion 50 moves the carriage 12 towards antenna 60 of the transmitter-receiver portion, and when the antenna 37 and the antenna 60 are in a positional relationship so that signals are transmittable and receivable, a value of a used amount of ink at this time added with an initial used amount is written as information showing the used amount into the element (nonvolatile memory) 42 via the antenna 60 and 37. Further, the initial used amount stored in the RAM 52 is updated to a value of the used amount of ink at this time added with the initial used amount. Further, the used amount of the cartridge 32 in the RAM 52 is reset. Note that, the ink amount of the respective cartridges 31 to 34 used from the first time of reaching the threshold to the second time of reaching the threshold are, 56, 12, 23, and 13 (picoliters).

In this way, during printing, the control portion 50 accumulates the used amount of ink contained in the respective cartridges 31 to 34, and stores it in the RAM 52. Then, when the accumulated value of a certain cartridge reaches a threshold provided for that cartridge, the control portion 50 selects the ink cartridge, and writes the information showing the used amount of ink into the element of the cartridge. Then, the used amount of ink stored in the RAM 52 of the cartridge provided with the element written with the information, is reset.

It should be noted that, similarly to Embodiment 1, when writing into the respective elements 41 to 44 is conducted, a data writing command is sent to the elements. At that time, the respective elements 41 to 44 are accompanied with ID information already read from the respective elements. The element which has received this command confirms that the accompanied ID information is definitely the ID information of the element itself, information other than the requested ID information is sent back to a transmitter-receiver portion 45. Further, the writing into the element may be conducted in either state where the carriage 12 is stopped or where the carriage 12 is moving.

Further, as information for determining the writing timing of the information showing the used amount or residual quantity into the ink cartridge, a threshold information showing a threshold according to a capacity of ink which may be contained in an ink cartridge attached with the respective elements, may be stored in the respective elements. In this case, at a time of a "reading process of information other than ID information", the capacity information stored in the respective elements 41 to 44 are read by the printer body 11. The control portion 50 may store in the RAM 52 the threshold information itself which is read, or the value according to the threshold information as the threshold, for every ink cartridge.

Further, a bidirectional printing by a recording head 30 is possible; and in a case an accumulated value of a certain ink cartridge reaches the threshold provided for the ink cartridge, when the recording head 30 moves in a direction away from the writing member (a direction towards the right side printing region) and discharges ink to print; and further, if a printing data exists which is to be printed by discharging ink whilst the recording head 30 moves in a direction closer towards the left printing region, at least, after printing is conducted by the recording head 30 moving towards the left printing region, the writing member may write the information showing the used amount into the element. In this way, when conducting bidirectional printing, generation of waste time accompanying a writing operation is suppressed.

<<<Relation with Flushing Operation >>>

In the above explanation relating to Embodiment 2, when the control portion 50 determines that the accumulated value of any of the ink cartridges has reached the threshold, the control portion 50 selects such a cartridge, and immediately moves the carriage 12 towards the antenna 60 of the transmitter-receiver portion, and writes in information showing the used amount into the element, via the antenna.

The writing operation of the information showing the used amount into this element is preferably conducted in relation with a flushing operation which is conducted periodically (every certain period of time, or every number of times of predetermined movement of the carriage). Note that, the flushing position is provided at a right side non printing region and a left side non printing region as shown in FIG. 2. When conducting the flushing operation, it is necessary for the carriage 12 to move to the non printing region, but by conducting the writing operation of the information showing the used amount into the element in relation with the flushing operation, the carriage 12 does not have to be moved to the non printing region just for the writing operation.

For example, the writing member may write information showing the used amount into the element in this selected ink cartridge, in relation with the flushing operation first conducted after the accumulated value of a certain ink cartridge reaches the threshold provided for such an ink cartridge.

In the structure as shown in FIG. 2, when the accumulated value of the cartridge 32 is determined to have reached the threshold, and the cartridge 32 is selected, at the time of the flushing operation first conducted thereafter, the carriage 12 is moved to a direction of a left side non printing region, and at the flushing position, the flushing is conducted and information showing the used amount is written into the element 42 provided in the cartridge 32.

Further, in a case the accumulated value of the cartridge 31 is judged to have reached the threshold, and the cartridge 31 is selected, when the flushing operation is first conducted thereafter, the carriage 12 is moved to a direction of a left side non printing region, and on the way the carriage 12 moves to the flushing position, the information storing the used amount is written into the element 41 provided in the cartridge 31, and thereafter the flushing is performed at the flushing position.

Further, when the accumulated value of the cartridge 33 (or 34) is judged to have reached the threshold, and the cartridge 33 (or 34) is selected, at the time of the first flushing operation conducted thereafter, the carriage 12 is moved to a direction of a left side non printing region, and flushing is conducted at the flushing position, thereafter the carriage 12 is further moved to the direction of a left side non printing region, and the information showing the used amount may be written into the element 43 (or 44) provided in the cartridge 33 (or 34).

Furthermore, in FIG. 2, it is possible to configure that the transmitter-receiver portion 45 including the antenna 60 is arranged closer to the printing region side, and to provide, in order from the printing region side, the writing position into the elements 41 to 44 of all the cartridges 31 to 34, and the conducting position of the flushing operation.

In a case of the above illustrated structure, on the way the recording head 30 moves towards the conducting position of the flushing operation together with the carriage 12, for a flushing operation which is first conducted after an accumulated value of a certain ink cartridge reaches the threshold provided for the ink cartridge, while the element moving with the carriage 12 passes the antenna 60, the antenna 60 may write information showing the used amount.

Further, a plurality of printing modes with various printing speeds may be conducted, and in at least one printing mode of the plurality of printing modes, even in a case an accumulated value of a certain ink cartridge has reached the threshold provided for that ink cartridge, the writing member does not have to conduct the writing operation in relation with the flushing operation first conducted thereafter. According to the printing apparatus, for example, in a case of such a printing mode in which priority is given to printing speed, by not performing the writing operation, the printing speed may be further increased.

=Embodiment 3=

Next, Embodiment 3 is described. Differing points to those of Embodiment 1 and Embodiment 2 will be mainly described. A similar structure and process as Embodiment 1 and Embodiment 2 will be designated with the same character, and an explanation will be omitted or simplified thereof.

===Summary of Printing Apparatus===

Figure 11:
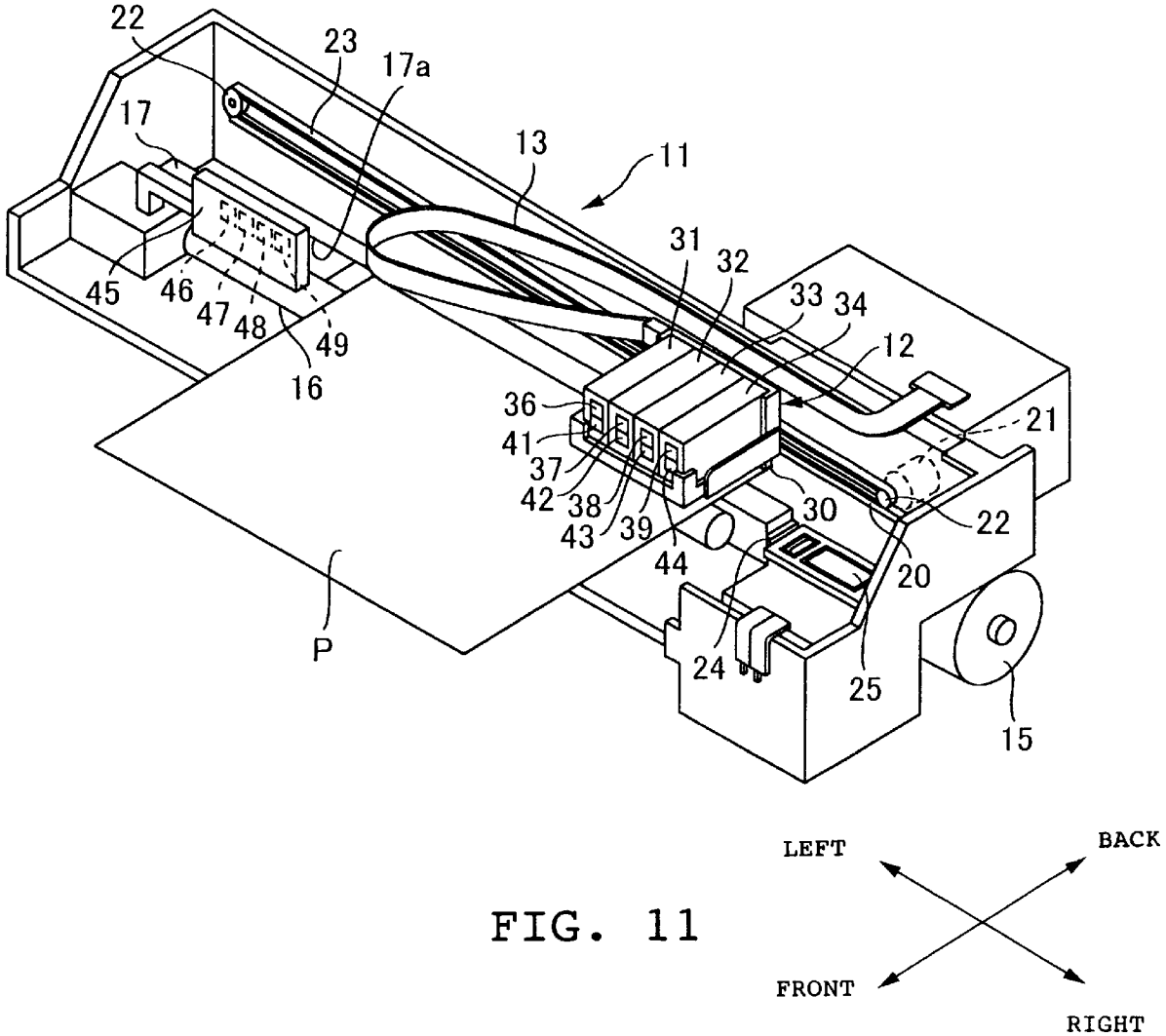
FIG. 11 is a schematic perspective view of an ink jet printer according to Embodiment 3.
Figure 12:
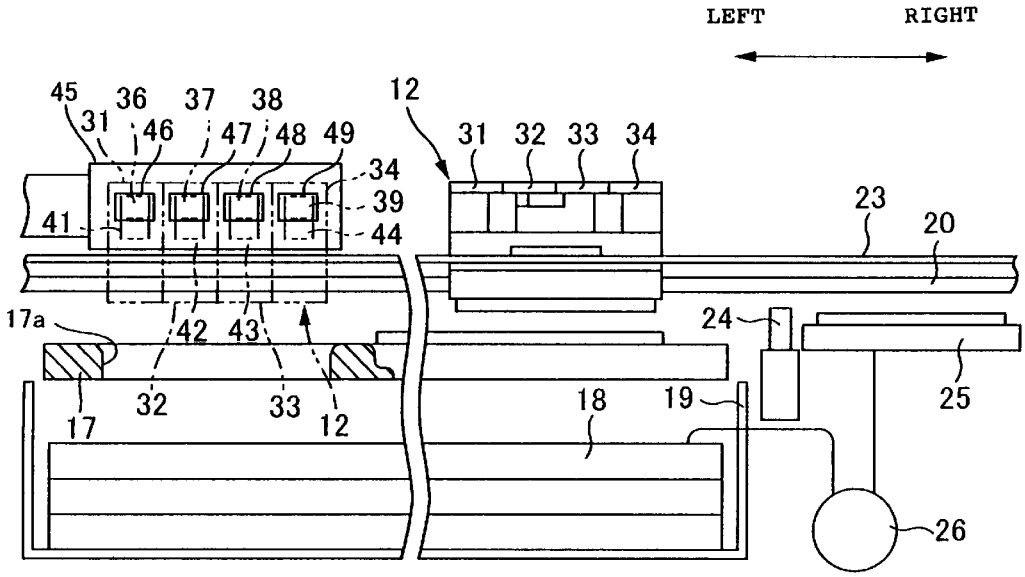
FIG. 12 is a schematic front view of an ink jet printer according to Embodiment 3.
Figure 13:
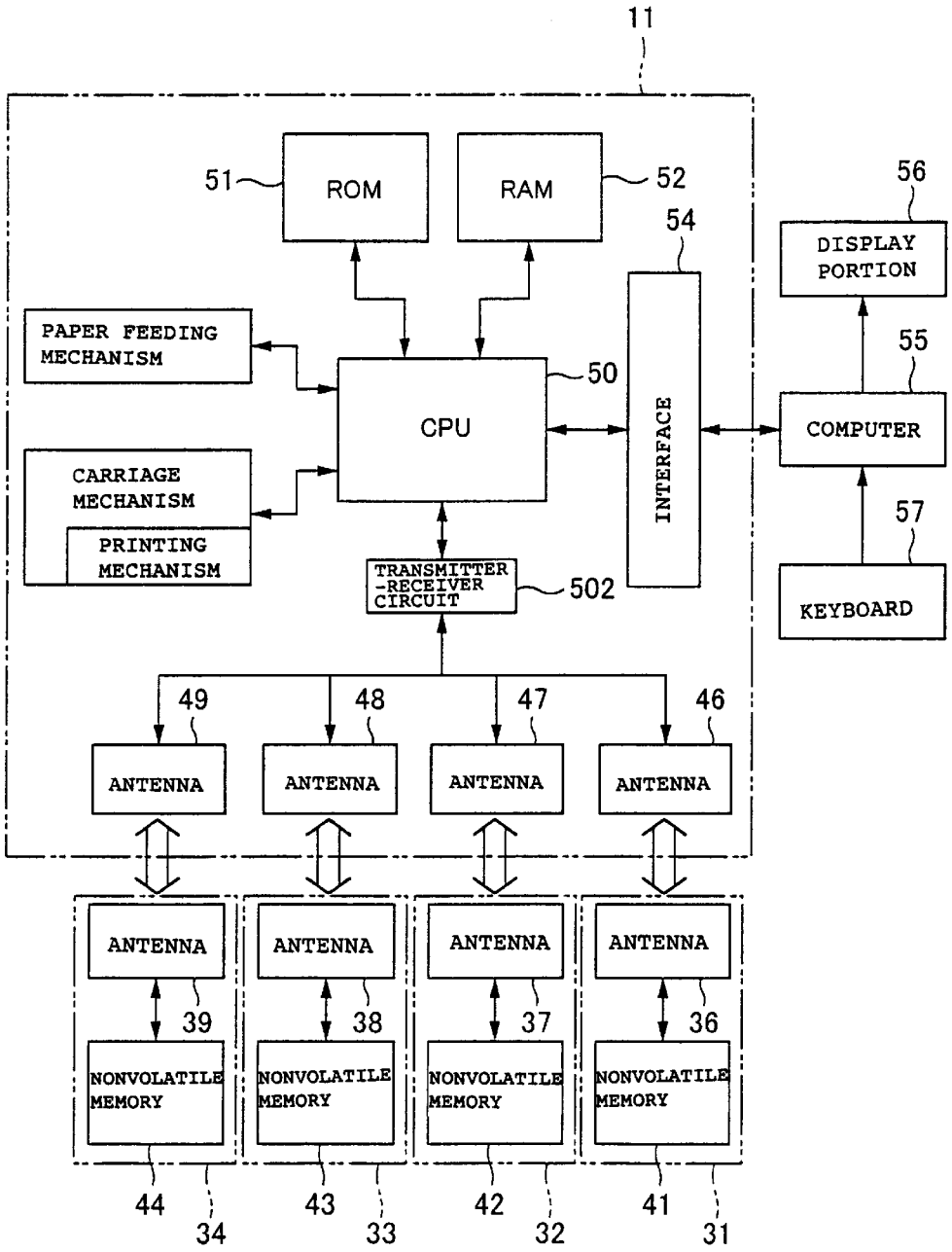
FIG. 13 is a block diagram showing a circuit structure of an ink jet printer according to Embodiment 3.

First, the summary of a printing apparatus will be explained by referring to FIGS. 11 to 13. FIG. 11 is a schematic perspective view of an ink jet printer according to this embodiment. FIG. 12 is a schematic front view of an ink jet printer according to this embodiment. FIG. 13 is a block diagram showing a circuit structure of an ink jet printer according to this embodiment.

As shown in FIGS. 11 and 12, above a hole 17*a* of a platen 17, there is provided a transmitter-receiver portion 45, and at a center of the transmitter-receiver portion 45, there are provided antennas 46, 47, 48 and 49 as writing members. These antennas 46 to 49 are structured so as to conduct transmitting and receiving in a noncontact state with the antennas 36 to 39, by opposing the antennas 36 to 39 respectively of the respective cartridges 31 to 34, when the ink discharge mouth (not shown in the drawing) of the recording head 30 is positioned above the hole 17*a* of the platen 17 (flushing position). Further, the antennas 46 to 49 of this transmitter-receiver portion 45 are connected to a control portion 50 via a transmitter-receiver circuit 502 of a printer body 11 via such as a cable not shown.

Further, as shown in FIG. 13, the control portion 50 is connected with antennas 46 to 49 by a serial bus, via the transmitter-receiver circuit 502, and via these antennas 46 to 49 and the antennas 36 to 39, input and output of such as attribution data of ink to the respective elements 41 to 44 having a nonvolatile memory are conducted in serial.

===Operation of Ink Jet Printer===

Next, an operation of an ink jet printer is described.

<<<ID Information Reading Process>>>

In this embodiment, first an ID information stored in the respective element is read by the printer body.

The ID information is communicated by using, for example, the antenna 49 which is closest to a printing region, out of the antennas 46 to 49 provided in the transmitter-receiver portion 45. In the process as described in Embodiment 1, a process where the antenna 60 in Embodiment 1 is replaced with antenna 49 is conducted, so that the ID information stored in the respective elements are read by the printer body 11.

<<<Reading Process of Information other than ID Information>>>

In this embodiment, a reading process of information other than the ID information in a state where the antennas 46, 47, 48, and 49 provided in the transmitter-receiver portion 45, are respectively opposed to the elements 41, 42, 43 and 44 provided in the respective cartridges 31, 32, 33, and 34 (in a state of FIG. 12).

In this state, a data reading command from the antenna 46 is sent to the element 41. At that time, the ID information of the element 41 which has already been read is accompanied to the element 41. The element 41 which has received this command, confirms that the accompanying ID information is definitely the ID information of the element 41 itself, and sends the information other than the requested ID information to the transmitter-receiver portion 45 via the antenna 46.

Next, in the relevant state (the state of FIG. 12), the data read command is sent from the antenna 47 to the element 42. At that time, the already read ID information of the element 42 is accompanied, to the element 42. The element 42 which has received this command confirms that the accompanying ID information is definitely the ID information of the element 42 itself, and sends the information other than the requested ID information to the transmitter-receiver portion 45 via the antenna 47. The same process is conducted to the other elements 43 and 44.

With the above process, an ink color information, an expiry period information and the like are read by the printer body 11, and stored in such as a RAM 52. When the above process is completed, the carriage 12 moves to a position where a capping means 25 is provided, and waits in a state where it is capped.

<<<Printing and Used Amount/Residual Quantity Writing Process>>>

Thereafter, in order to print an image or a character on a printing paper P, data of the image or character is sent from a computer 55 to a printer body 11 via an interface 54. Then, first a control portion 50 of the printer body 11 gives a signal to a paper feed mechanism, and starts feeding the printing paper P. Next, the control portion 50 gives a signal to a carriage mechanism, and whilst moving a carriage 12, discharges ink drops according to the image and character from a recording head 30. At this time, the control portion 50 stores the amount of ink drops of each cartridge and a number of times of discharge to the RAM 52. Namely, for every ink cartridge mounted on a cartridge mounting portion 80 of the carriage 12, the discharge amount of ink discharged towards the printing paper P which is the printing medium is accumulated.

After the carriage 12 is reciprocated for a predetermined number of times along a guide member 20, the control portion 50 moves the carriage 12 to a flushing position in the left side non printing region, then gives a signal to the carriage mechanism and discharges a predetermined amount of ink from the recording head 30, namely conducts a flushing operation.

At the same time, the control portion 50 selects a cartridge with the most used amount of ink from data of the RAM 52.

In this embodiment, as shown in FIG. 12, at the position where the flushing operation is conducted, the elements 41 to 44 provided in each cartridge 31 to 34 may be written respectively with information via the antennas 46 to 49.

Therefore, the control portion 50 does not have to move the carriage 12 along the guide member 20, and the element of the selected cartridge is written with information showing the used amount of ink. Further, the initial used amount stored in the RAM 52 is updated to a value of the used amount of ink at this time added with the initial used amount. Further, the control portion 50 resets data of the used amount of the selected cartridge stored in the RAM 52. Namely, the control portion 50 resets the accumulated value of the selected cartridge.

When such an operation is completed, the control portion 50 again gives a signal to the carriage mechanism, and resumes printing. Then, the used amount of ink during this printing, is accumulated in the RAM 52.

Note that, this used amount of ink also includes the amount of ink used in the previous flushing operation. Then, after the at carriage 12 has reciprocated for a predetermined number of times, the carriage 12 is again moved to a flushing position, and the flushing operation is conducted. At the same time, the control portion 50 selects the cartridge with the most used amount until then.

In this case, in a position for conducting the flushing operation, the elements 41 to 44 provided in the respective cartridges 31 to 34, may respectively be written with information via the antennas 46 to 49.

Therefore, the control portion 50 writes information showing the used amount of ink into the element of the selected cartridge, without moving the carriage 12 along the guide member 20. Further, the initial used amount stored in the RAM 52 is updated to a value of the used amount of ink at this time added with the initial used amount. Further, the control portion 50 resets data of the used amount of the selected cartridge stored in the RAM 52. Namely, the control portion 50 resets the accumulated value of the selected cartridge.

In this way, during printing, the control portion 50 accumulates the used amount of ink contained in the respective cartridges 31 to 34, and stores it in the RAM 52. Then, the control portion 50 conducts the flushing operation every time the carriage during printing reciprocates for a predetermined number of times, and writes information showing the used amount of ink into the elements 41 to 44 of the cartridges 31 to 34 which are judged to have the most ink consumption amount. Then, the used amount of ink stored in the RAM 52 of the cartridges 31 to 34 provided with the respective elements 41 to 44 written in with the information, are reset.

Further, when writing into each element 41 to 44, the data writing command is sent to the element. At that time, each element 41 to 44 is accompanied with the already read ID information of each element. The element that receives this command confirms that the accompanied ID information is definitely the ID information of the element itself, and sends the information other than the requested ID information to the transmitter-receiver portion 45.

Further, from the point of view of writing information in a short time, when writing information showing the used amount into the element, it is preferable to write only the information showing the used amount or residual quantity.

=Embodiment 4=

Next, Embodiment 4 is described. In Embodiment 4, a used amount or residual quantity writing process differ from that of Embodiment 3. The other structures are similar to that of Embodiment 3, and differing points will mainly be described.

In Embodiment 3, after reciprocating a carriage 12 for a predetermined number of times along a guide member 20, the carriage 12 is moved to a flushing position, namely a flushing operation is conducted. When conducting this flushing operation, a control portion 50 selects a cartridge with the most ink used amount from data of a RAM 52.

In Embodiment 4, after starting printing, the control portion 50 selects the cartridge at the time the data of the RAM 52 reaches a threshold. Hereinbelow, it is described in detail.

In this embodiment, a "reading process of information other than ID information" as described in Embodiment 3 is conducted, and at that time, a capacity information of ink which may be contained in an ink cartridge attached with the respective elements as information for determining a writing timing of information showing a used amount or residual quantity to the cartridge, which is the information other than the ID information, is read by a printer body 11. The control portion 50 stores in the RAM 52 a value of a 1% of the capacity information as the threshold for every ink cartridge.

<<<Printing and Used Amount/Residual Quantity Writing Process in this Embodiment>>>

In order to print the image or the character on a printing paper P, the data of the image and the character are sent from a computer 55 to the printer body 11 via an interface 54. Then, first, the control portion 50 of the printer body 11 gives a signal to a paper feed mechanism, and starts sending the printing paper P. Next, the control portion 50 gives a signal to a carriage mechanism, and whilst moving the carriage 12, ink drops according to the image or character are discharged from a recording head 30 thereof. At this time, the control portion 50 stores the amount of the ink drops and the number of times of discharge of each cartridge in the RAM 52. Namely, a discharge amount of ink discharged towards the printing paper P which is a printing medium is accumulated for every ink cartridge held in a cartridge mounting portion 80 of the carriage 12.

An accumulated value which is an accumulated result, is judged whether it has reached a threshold or not for every cartridge. If the control portion 50 judges that the accumulated value of any of the ink cartridges has reached the threshold, the control portion 50 selects such a cartridge.

Then, the control portion 50 moves the carriage 12 to the transmitter-receiver portion 45, and with the respective antennas 36 to 39 and the respective antennas 46 to 49 in a positional relationship where signals are transmittable and receivable respectively, information showing a used amount of ink at this time is written into the element of the selected cartridge. Further, the initial used amount stored in the RAM 52, is updated to a value of the used amount of ink at this time accumulated with the initial used amount. Further, the control portion 50 resets data of the used amount of the selected cartridge stored in the RAM 52. Namely, the control portion 50 resets the accumulated value of the cartridge.

When such an operation is completed, the control portion 50 again gives a signal to the carriage mechanism, and resumes printing. Then, the discharge amount of ink discharged towards the printing paper P which is the printing medium during this printing, is accumulated for every ink cartridge.

The accumulated value which is the accumulated result is judged whether it has reached the threshold or not for every ink cartridge. When the control portion 50 judges that the accumulated value of any of the ink cartridges has reached the threshold, such an ink cartridge is selected.

Then, the control portion 50 moves the carriage 12 to the transmitter-receiver portion 45, and when the respective antennas 36 to 39 and the respective antennas 46 to 49 are in a positional relationship so that signals are transmittable and receivable, information showing the used amount value of ink is written into the element of the selected cartridge. Further, the initial used amount stored in the RAM 52 is updated to a value of the used amount of ink at this time accumulated with the initial used amount. Further, data of the used amount of the selected cartridge stored in the RAM 52, is reset. Namely, the accumulated value of the cartridge is reset.

In this way, during printing, the control portion 50 accumulates the used amount of ink stored in the respective cartridges 31 to 34, and stores it in the RAM 52. Then, when the accumulated value of a certain cartridge reaches a threshold provided for that cartridge, the control portion 50 selects such an ink cartridge, and writes information showing the used amount of ink into the element of that cartridge. Then, the used amount of ink stored in the RAM 52 of the cartridge provided with the element written with the information, is reset.

Note that, similarly to Embodiment 3, when writing into the respective elements 41 to 44 are conducted, a data writing command is sent to the elements. At that time, the respective elements 41 to 44 are accompanied with ID information already read from respective elements. When the element receiving this command confirms that the accompanied ID information is definitely the ID information of the element itself, information other than the requested ID information is sent back to a transmitter-receiver portion 45. Further, the writing into the element may be conducted in a state where the carriage 12 is stopped or in a state where the carriage 12 is moving.

Further, as information for determining the writing timing of the information showing the used amount or residual quantity into the ink cartridge, a threshold information showing a threshold according to a capacity of ink which may be contained in an ink cartridge attached with the respective elements, may be stored in the respective elements. In this case, at the time of "reading process of information other than ID information", the threshold information stored in the respective elements 41 to 44 are read by the printer body 11. The control portion 50 may store in the RAM 52 the threshold information itself which is read, or the value according to the threshold information as the threshold, for every ink cartridge.

Further, when writing the information showing the used amount into the element of the selected cartridge, the control portion 50 moves the carriage 12 to the transmitter-receiver portion 45, and in a positional relationship where the antenna of the selected element opposes the antenna 49 which is an antenna arranged closest to the printing region out of the antennas 46 to 49, the writing of the information showing the used amount may be conducted using this antenna 49.

<<<Relation with Flushing Operation>>>

In the above explanation relating to Embodiment 4, when the control portion 50 judges that the accumulated value of any of the ink cartridges has reached the threshold, the control portion 50 selects such a cartridge, and immediately moves the carriage 12 towards the transmitter-receiver portion 45, and writes information showing the used amount into the element, via the antenna.

The writing operation of information showing the used amount into this element is preferably conducted related with a flushing operation which is conducted periodically (every certain period of time, or every number of times of predetermined movement of the carriage). Note that, the flushing position is provided at a right side non printing region and a left side non printing region as shown in FIG. 12. When conducting the flushing operation, it is necessary for the carriage 12 to move to the non printing region, but by conducting the writing operation of information showing the used amount into the element in relation with the flushing operation, it is not necessary to move the carriage 12 to the non printing region just for the writing operation.

For example, the writing member preferably writes information showing the used amount of the element provided in this selected ink cartridge, in relation with the flushing operation first conducted after the accumulated value of a certain ink cartridge reaches a threshold provided for such an ink cartridge.

In the structure as shown in FIG. 12, at a position conducting a flushing position, writing of the information into each element is possible, so that when the accumulated value of any of the cartridges is judged to have reached the threshold, and the cartridge is selected, at the time of the first flushing operation conducted thereafter, the carriage 12 is moved to a direction of a left side non printing region, and at the flushing position, the flushing is conducted as well as the information showing the used amount is written into the element provided in the cartridge.

Furthermore, in FIG. 12, it is possible to have a structure with the transmitter-receiver portion 45 of the antennas 46 to 49 arranged closer to the side of the printing region, and to provide, in order from the printing region side, the writing position to the elements 41 to 44 of all the cartridges 31 to 34 and the conducting position of the flushing operation.

When it is structured as above, for a first flushing operation which is conducted after an accumulated value of a certain ink cartridge reaches the threshold provided for the ink cartridge, on the way the recording head 30 heads towards the flushing operation conducting position with the carriage 12, the antenna 60 may write information showing the used amount when the element moving with the carriage 12 passes the antennas 46 to 49.

=Other Embodiments=

As above, such as a printing apparatus according to the present invention based on a number of embodiments are explained, and the above embodiments of the invention are for a better understanding of the present invention, and do not limit the present invention. The present invention may be altered and modified without departing from the scope of the invention, needless to say by including the equivalents thereof.

In the above embodiment, a non contact IC chip is used as an element, but it is not limited to a structure thereof as long as information is storable, for example, it may be integral with such as an antenna.

An ink cartridge is a structure such that ink may be contained, and is preferably detachable from the printing apparatus body, for example, may further comprise such as an ink discharge head as well as an ink containing portion.

A position where the element is attached to the ink cartridge is not limited to a front face of the ink cartridge, but may be an arbitrary position, and its attaching may be achieved by various methods such as adhesion and injection.

An accumulating means for accumulating a discharge amount of ink for every ink cartridge is not limited to a CPU and a program read by this, but may be realized by an electronic circuit designated for accumulating.

Writing information into the element is preferably conducted in a non contact state, but may also be conducted in a contact state.

A position of the antenna at a printer body side which is a writing member is not limited to the position shown in the respective embodiments (left side non printing region), and for example, may be arranged in a right side non printing region.

The selection based on the accumulated result of the accumulating means is not limited to the CPU and the program read thereby, and may be realized by an electronic circuit designated for conducting the relevant selection.

The selection based on the accumulated result of the accumulating means is not limited to selecting one cartridge, and may be a selection of a plurality of ink cartridges. For example, cartridges with the largest and the next largest accumulated values may be selected.

Instead of writing the information showing the used amount into the element, the information showing the residual quantity may be written. Further, it may be a structure for writing the information showing the used amount or residual quantity, and the written information is not necessarily the used amount or residual quantity itself, and may be for example, such as information of how many percent is used, and information that may grasp directly or indirectly the used amount or residual quantity.

A threshold may be a value referred to when comparing, and its unit is not limited to liters, picoliters, or the like.

When setting the threshold according to the capacity of the ink cartridge, it is not limited to a case of where it is set to such as 1% of a capacity, but for example, the capacity may be divided into a plurality of levels having a predetermined range (large capacity, medium capacity, small capacity, or the like), and may be set to the threshold for every level.

At the time of writing the used amount or residual quantity into the element, it is preferable to reset the accumulated value to the selected ink cartridge, but even without resetting, a predetermined value may be subtracted from the accumulated value, or the accumulated value may be divided by the predetermined value. A computer system comprising such as the ink jet printer according to the above embodiment, the computer body, if necessary, a display device such as CRT, an input device such as a mouse or a keyboard, a flexible drive device, a CD-ROM drive, or the like may be realized, and a computer system realized in this way, may be a system that is superior as an entire system to a conventional system.

Further, the ink jet printer according to the above embodiments, may have the functions or a part of the mechanism of the computer body, the display device, the input device, the flexible disk drive device, and the CD-ROM drive device, respectively. For example, the printer may be a structure having an image process portion conducting image processing, a display portion conducting various displays, and a recording media detaching portion for detaching recording media recording image data taken by such as a digital camera.

Further, in the above embodiments, the ink jet printer is used as the printing apparatus, but for example, it may be applied to such as a copying machine using an ink jet method, a facsimile, and a dying machine.

This specification and the attached drawings disclose various constituent elements of the invention, and regarding the printing device, a required constituent element is that the ink cartridge with the element is detachable, and information may be written into the element, and regarding the ink cartridge, a required constituent element is that it has an element. Various inventions may of course be realized by combining the required constituent elements with other constituent elements respectively arbitrarily, or one by one.

According to the present invention, the printing apparatus which may effectively manage the information regarding the respective ink cartridges, and the ink cartridge may be realized.

What is claimed is:

1. An ink cartridge which may contain ink and is detachably mountable on a printing apparatus body, comprising an element into which information may be written, wherein said element may be written with information showing a used amount or residual quantity of ink contained in said ink cartridge, and information for determining a writing timing of said information showing said used amount or residual quantity to said ink cartridge.

2. An ink cartridge according to claim 1, wherein said element may be written with said information in a noncontact state.

3. An ink cartridge according to claim 2, wherein said element is stored with an ID information inherent to said element.

4. An ink cartridge according to claim 3, wherein said element is recognized by said ID information, and then said element is written with said information.

5. An ink cartridge according to claim 1, wherein said information for determining said writing timing is a capacity information showing a capacity of ink which may be contained in said ink cartridge.

6. An ink cartridge according to claim 3, wherein:

when said ink cartridge is mounted on a cartridge mounting portion of a printing apparatus body having said cartridge mounting portion on which a plurality of ink cartridges are detachably mountable, an accumulating means for accumulating a discharge amount of ink discharged for every ink cartridge mounted on said cartridge mounting portion, and a writing member for writing said information into said element, said capacity information is read by said printing apparatus body, and a threshold based on said capacity information is set; and when an accumulated value which is an accumulated result by said accumulating means, of said ink cartridge reaches said threshold, said element is written with information showing said used amount or residual quantity of said ink by said writing member.

7. An ink cartridge according to claim 1, wherein information for determining a writing timing is a threshold information showing a threshold according to a capacity of ink which may be contained in said ink cartridge.

8. A printing apparatus comprising:

a cartridge mount on which a first ink cartridge and a second ink cartridge are detachably mountable, said first ink cartridge having a first memory, and said second cartridge having a second memory; and a control circuit that determines a first discharge amount of ink discharged from said first ink cartridge and that determines a second discharge amount of ink discharged from said second ink cartridge;

wherein said control circuit selects said first ink cartridge or said second ink cartridge based on at least one of said discharge amount and said second discharge amount, wherein, when said control circuit selects said first ink cartridge, said control circuit causes information to be written to said first memory, and wherein, when said control circuit selects the first ink cartridge, information is not written to said second memory.

9. A printing apparatus according to claim 8, wherein said information written to said first memory comprises a used amount or residual quantity of ink contained in said first ink cartridge.

10. A printing apparatus according to claim 10, wherein, when said control circuit causes said information to be written to said first memory and not to be written to the second memory, a value of said first discharge amount is adjusted and a value of said second discharge amount is not adjusted.

11. A printing apparatus according to claim 8, wherein said control circuit communicates with said first memory, in a noncontact state, when said cartridge mount is at a predetermined position.

12. A printing apparatus according to claim 8, wherein said control circuit selects said first ink cartridge when said first discharge amount reaches a first predetermined value.

13. A printing apparatus according to claim 12, wherein said first predetermined value for said first ink cartridge is established according to an ink capacity of said first ink cartridge.

14. A printing apparatus according to claim 12, further comprising:

a first writing member for writing information to said first memory:

wherein, when said first ink cartridge moves in a direction away from said writing member, said information is not written to said first memory, and wherein, when said first ink cartridge moves in a direction towards said writing member, said information is written to said first memory.

15. A printing apparatus according to claim 12, wherein said first memory stores first timing information for determining a writing timing of said information relating to a capacity of ink in said first ink cartridge, and wherein said first predetermined value is set according to said first timing information.

16. A printing apparatus according to claim 15, wherein said first timing information comprises capacity information relating to an ink capacity of said first ink cartridge, and wherein said first predetermined value is set according to said capacity information.

17. A printing apparatus according to claim 12, wherein said first memory stores first timing information for determining a writing timing of said information relating to a capacity of ink in said first ink cartridge, and wherein said first predetermined value is set according to said first timing information.

18. A printing apparatus according to claim 8, wherein said first memory stores first timing information for determining a writing timing of said information relating to a used amount or residual quantity of said first ink cartridge, and wherein said first predetermined value is set according to said first timing information.

19. A printing apparatus according to claim 18, wherein said first timing information comprises capacity information relating to an ink capacity of said first ink cartridge, and wherein said first predetermined value is set according to said capacity information.

20. A printing apparatus according to claim 19, wherein said first ink cartridge is moveable from a printing region to a writing position at which said information is written to said first memory and to a flushing position at which said flushing operation is performed;

wherein said writing position is located between said printing region and said flushing position, and wherein said information is written to said first memory as said first ink cartridge moves from said printing region to said flushing position.

21. A printing apparatus according to claim 20, wherein said writing member writes only information showing a used amount or residual quantity.

22. A printing apparatus according to claim 8, further comprising:

a first writing member that opposes said first memory during a flushing operation of said first ink cartridge; and a second writing member that opposes said second memory during a flushing operation of said second ink cartridge.

23. A printing apparatus according to claim 8, wherein, during a printing mode in which a print operation is performed, said control circuit does not write any information to said first memory in relation with a flushing operation for discharging ink.

24. A printing apparatus according to claim 8, further comprising a writing member that writes said first information to said first memory of said first ink cartridge.

25. A printing apparatus according to claim 24, further comprising a first discharge head for discharging ink from said first ink cartridge, wherein said first discharge head moves with said first ink cartridge, and wherein, when said first discharge head is positioned in a discharge position to discharge ink during a flushing operation, said writing head opposes said first memory.

26. A printing apparatus according to claim 8, further comprising:

a first read/write member coupled to said control circuit; and a second read/write member coupled to said control circuit;

wherein said first read/write member is adapted to read first ID information stored in said first memory, wherein said second read/write member is adapted to read second ID information stored in said second memory, and wherein, after said first ID information is read via said first read/write member, said control circuit subsequently recognizes said first read/write member by said first ID information without conducting a subsequent reading operation.

27. An ink cartridge detachably mountable on a printing apparatus body, comprising:

a memory into which information is written, wherein said information indicates a used amount or residual quantity of ink contained in said ink cartridge, and wherein said information identifies a writing timing at which said information is to be updated.

28. An ink cartridge according to claim 27, wherein said memory is written via a source when said source and memory are in a noncontact state.

29. An ink cartridge according to claim 28, wherein said memory stores an ID information that identifies said memory.

30. An ink cartridge according to claim 27, wherein said information for determining said writing timing comprises capacity information showing an ink capacity of said ink cartridge.

31. An ink cartridge according to claim 27, wherein said information that identifies said writing timing is a predetermined value according to an ink capacity of said ink cartridge.

* * * * *